US008765337B2

(12) United States Patent
Maruo et al.

(10) Patent No.: US 8,765,337 B2
(45) Date of Patent: Jul. 1, 2014

(54) MULTILAYER TYPE ELECTROPHOTOGRAPHIC PHOTOCONDUCTOR AND IMAGE FORMING APPARATUS

(75) Inventors: Keiji Maruo, Osaka (JP); Junichiro Otsubo, Osaka (JP); Jun Azuma, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 1288 days.

(21) Appl. No.: 11/805,588

(22) Filed: May 24, 2007

(65) Prior Publication Data

US 2007/0281227 A1 Dec. 6, 2007

(30) Foreign Application Priority Data

May 30, 2006 (JP) ..... 2006-150070

(51) Int. Cl.
*G03G 5/047* (2006.01)

(52) U.S. Cl.
USPC ..... 430/58.75; 430/58.8; 430/58.85; 430/59.5; 399/159

(58) Field of Classification Search
USPC ..... 430/58.05, 58.75, 58.85, 59.5, 58.8, 430/59.4; 399/159
See application file for complete search history.

(56) References Cited

U.S. PATENT DOCUMENTS

2002/0160294 A1* 10/2002 Okuno et al. ..... 430/124
2004/0049027 A1* 3/2004 Hamasaki et al. ..... 540/135
2004/0126140 A1* 7/2004 Azuma et al. ..... 399/159
2005/0175911 A1* 8/2005 Tamoto et al. ..... 430/58.7
2007/0111123 A1* 5/2007 Otsubo et al. ..... 430/78

FOREIGN PATENT DOCUMENTS

| | | |
|---|---|---|
| JP | 07-199487 | 8/1995 |
| JP | 07-219251 | 8/1995 |
| JP | 2000-284511 A | 10/2000 |
| JP | 2002-296820 A | 10/2002 |
| JP | 2004-133253 A | 4/2004 |
| JP | 2005-049470 A | 2/2005 |

* cited by examiner

*Primary Examiner* — Christopher Rodee
(74) *Attorney, Agent, or Firm* — Carmody Torrance Sandak & Hennessey LLP

(57) ABSTRACT

The present invention is to provide a multilayer type electrophotographic photoconductor capable of stably obtaining a high image quality image over a long term by restraining the exposure memory and the photo memory, and an image forming apparatus comprising such a multilayer type electrophotographic photoconductor. A multilayer type electrophotographic photoconductor comprising a charge generating layer containing at least a charge generating agent on a base member directly or via an intermediate layer, and a charge transporting layer containing at least a charge transporting agent and a binder resin formed successively, wherein the light absorption degree at a 680 nm wavelength light beam in the photoconductive layer of the multilayer type electrophotographic photoconductor is of a value of 0.8 or less, and the light absorption degree at a 450 nm wavelength light beam is of a value of 1.0 or more, and an image forming apparatus comprising such a multilayer type electrophotographic photoconductor are provided.

8 Claims, 12 Drawing Sheets

MULTILAYER TYPE ELECTROPHOTOGRAPHIC PHOTOCONDUCTOR AND IMAGE FORMING APPARATUS

BACKGROUND OF THE INVENTION

1. Field of the Invention

The present invention relates to a multilayer type electrophotographic photoconductor and an image forming apparatus. In particular, it relates to a multilayer type electrophotographic photoconductor capable of restraining generation of the exposure memory and the photo memory by limiting the light absorption degree (light absorbance) of a predetermined wavelength in a photoconductive layer, and an image forming apparatus comprising such a multilayer type electrophotographic photoconductor.

2. Description of the Related Art

Conventionally, as an electrophotographic photoconductor used for an electrophotographic machine such as a copying machine and a laser printer, an inorganic photoconductor comprising a photoconductive layer made of an inorganic material such as amorphous silicon, and an organic photoconductor comprising a photoconductive layer containing a charge generating agent, a charge transporting agent, and a binder resin, are known.

Among these photoconductors, the organic photoconductor having the production convenience and additionally, the excellent freedom in the structure design owing to the variety of the selection range of the charge generating agent, the charge transporting agent, or the like, is widely used. Moreover, the organic photoconductor is roughly classified into a single layer type organic photoconductor and a multilayer type organic photoconductor in terms of the layer configuration. In particular, since the multilayer type organic photoconductor has the functions separated per each layer, it is advantageous in terms of the design easiness and the function control so that it is widely used recently.

However, since the multilayer type organic photoconductor contains the charge generating agent and the charge transporting agent in different layers, the charge transporting ability in the charge generating layer can easily be lowered so that a problem of the image characteristic deterioration due to the charge accumulation inside the layer is involved.

In particular, problems of generation of the so-called exposure memory of transferring the charge generated in the previous rounds and accumulated inside the charge generating layer to an image in the following rounds, or the so-called photo memory of the influence to the evenness of the initial charge caused by the charge generated by the external beam accumulated inside the charge generating layer have been observed.

Then, for solving these problems, a method for improving the charge characteristics by improving the charge transporting ability in the charge generating layer by containing an electron transferring agent in the charge generating layer in a positive charge type multilayer type electrophotographic photoconductor has been proposed.

More specifically, a multilayer type electrophotographic photoconductor containing the same binder resin in the charge generating layer and the charge transfer layer, and an accepter compound contained having the electron transporting ability in the charge generating layer and the charge transporting layer has been proposed (for example, see patent documents 1 and 2).

[Patent document 1] JPH07-199487A (claims)

[Patent document 2] JPH07-219251A (claims)

However, although the multilayer type electrophotographic photoconductors disclosed in patent documents 1 and 2 improve the charge characteristics, depending on the photoconductor material to be used, the printing conditions, or the like, the charge is accumulated in the charge generating layer so that the charge characteristics may be lowered.

In particular, depending on the kind of the charge generating agent or the charge transporting agent, the charge transporting ability may not be sufficiently obtained, or on the contrary, due to the excessive sensitivity to the exposure light source, the exposure memory may be generated. Moreover, in the case of the exposure of the electrophotographic photoconductor to the external beam for a long time at the time of replacement, or the like, the photo memory is also generated so that the charge characteristics may be lowered.

SUMMARY OF THE INVENTION

Then, as a result of the elaborate discussion of the present inventors, it was found out that the excellent charge characteristics can be obtained stably even in the case of continuously forming an image by restraining the excessive charge generation at the time of receiving a light beam from the exposure light source as well as restraining the abnormal charge generation at the time of receiving an external beam by limiting the light absorption degree at a predetermined wavelength in a photoconductive layer of a multilayer type electrophotographic photoconductor so as to complete the present invention.

That is, an object of the present invention is to provide a multilayer type electrophotographic photoconductor capable of stably obtaining a high image quality image over a long term by each restraining the exposure memory generated from the exposure light source, and the photo memory generated from an external beam, or the like, and an image forming apparatus comprising such a multilayer type electrophotographic photoconductor.

According to the present invention, a multilayer type electrophotographic photoconductor comprising a charge generating layer containing at least a charge generating agent on a base member directly or via an intermediate layer, and a charge transporting layer containing at least a charge transporting agent and a binder resin formed successively, wherein the light absorption degree at a 680 nm wavelength light beam in the photoconductive layer of the multilayer type electrophotographic photoconductor is of a value of 0.8 or less, and the light absorption degree at a 450 nm wavelength light beam is of a value of 1.0 or more is provided so as to solve the above-mentioned problems.

That is, since the light absorption degree at a 680 nm wavelength light beam is limited to a predetermined value or less, in particular, the sensitivity to a light beam of the exposure light source can be adequately limited so that the excessive charge generation can effectively be prevented. Therefore, an electrophotographic photoconductor with little exposure memory generation can be provided without residual charge accumulation in the charge generating layer.

On the other hand, since the light absorption degree at a 450 nm wavelength light beam is controlled to a predetermined value or more, the abnormal charge generation can effectively be prevented by in particular absorbing an external beam of a solar beam or a fluorescent lamp so as not to contribute to the charge generation.

In the present invention, the light absorption degree is defined to be the logarithm intensity ratio ($-\log(I_r/I_0)$) of the reflection beam ($I_r$) to the incident beam ($I_0$). The larger value of the logarithm intensity ratio denotes, the more light absorption amount is showed at the point. Moreover, as a method for adjusting the light absorption degree, the change (variation) of the kind and the addition amount of the charge transporting agent, the charge generating agent and the binder resin comprising the photoconductive layer, the kind and the addition amount of the wavelength adjusting agent, the thickness of the charge transporting layer, or the like may be adopted.

In the multilayer type electrophotographic photoconductor of the present invention, it is preferable that the light absorption degree at a 680 nm wavelength light beam in the charge generating layer is of a value of 0.8 or less.

According to the configuration, in particular, the sensitivity with respect to the exposure light source in the charge generating layer may be adequately controlled so that generation of the exposure memory derived from the residual charge accumulated in the charge generating layer can effectively be prevented.

In the multilayer type electrophotographic photoconductor of the present invention, it is preferable that the content of the charge generating agent in the charge generating layer is of a value within a range of 3 to 80% by weight with respect to the total amount in the charge generating layer.

According to the configuration, in particular, the light absorption degree at a 680 nm wavelength light beam in the charge generating layer can be controlled by the content of the charge generating agent so that generation of the exposure memory can be restrained easily and certainly.

In the multilayer type electrophotographic photoconductor of the present invention, it is preferable that the light absorption degree at a 450 nm wavelength light beam in the charge transporting layer is of a value of 1.0 or more.

According to the configuration, in particular, the external beam may be absorbed in the charge transporting layer provided above the charge generating layer so that it prevents the beam from reaching to the charge generating layer. Therefore, generation of the photo memory can effectively be prevented by reducing the charge generated derived from the external beam.

In the multilayer type electrophotographic photoconductor of the present invention, it is preferable that the ionizing potential of the charge transporting agent is of a value of 5.3 eV or more.

According to the configuration, the charge transporting ability in the charge transporting layer may be improved so that the sensitivity as the photoconductive layer may be maintained at a constant level even in the case of adopting a technique of reducing the content of the charge generating agent as a means for reducing the exposure memory.

In the multilayer type electrophotographic photoconductor of the present invention, it is preferable that the time necessary for attenuating the charge potential to 95% of the potential range ($V_1$-$V_2$) is 10 msec or less with the premise that the initial charge potential of the multilayer type electrophotographic photoconductor is $V_1$ (V) and the charge potential after passage of 300 msec after the exposure is $V_2$ (V).

According to the configuration, the charge characteristics of the electrophotographic photoconductor may be controlled from the photo response property so that an electrophotographic photoconductor capable of not only restraining generation of the exposure memory and the photo memory but also having the excellent photo response property may be obtained.

Moreover, another aspect of the present invention is an image forming apparatus comprising a multilayer type electrophotographic photoconductor having a charge generating layer containing at least a charge generating agent on a base member directly or via an intermediate layer, and a charge transporting layer containing at least a charge transporting agent and a binder resin formed successively, wherein a charging means, an exposure means, a developing means and a transfer means are provided around the multilayer type electrophotographic photoconductor, the light absorption degree at a 680 nm wavelength light beam in the photoconductive layer of the multilayer type electrophotographic photoconductor is of a value of 0.8 or less, and the light absorption degree at a 450 nm wavelength light beam is of a value of 1.0 or more.

According to the image forming apparatus, the light absorption degree of a predetermined wavelength in the photoconductive layer can be limited so that a high image quality image can be provided over a long term with little generation of the exposure memory and the photo memory.

BEST MODE FOR CARRYING OUT THE INVENTION

[First Embodiment]

Figure 1:
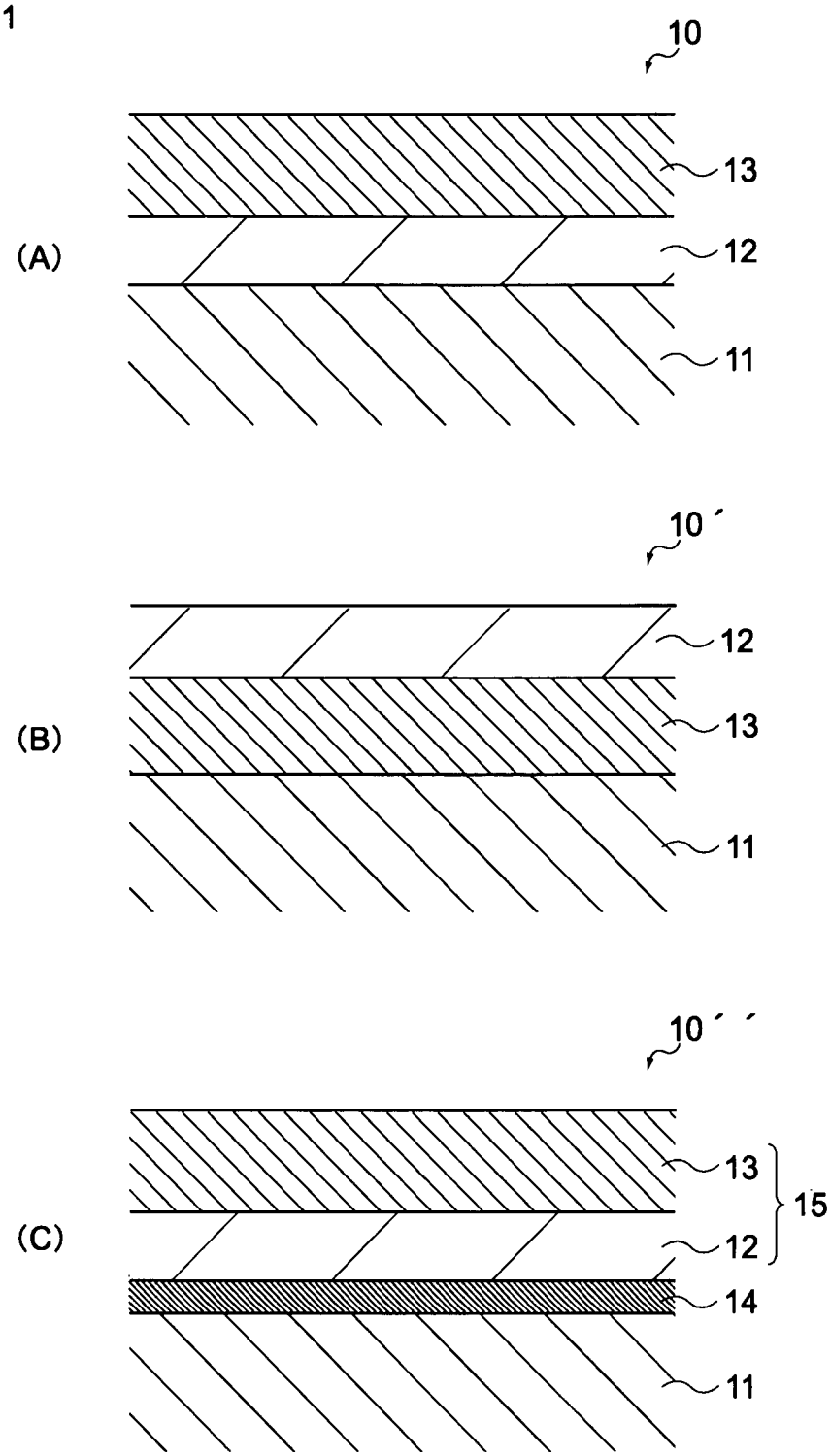
FIGS. 1A to 1C are a cross-sectional view showing a configuration example of a multilayer type electrophotographic photoconductor.

A first embodiment of the present invention is a multilayer type electrophotographic photoconductor comprising a charge generating layer containing at least a charge generating agent on a base member directly or via an intermediate layer, and a charge transporting layer containing at least a charge transporting agent and a binder resin formed successively, wherein the light absorption degree at a 680 nm wavelength light beam in the photoconductive layer of the multilayer type electrophotographic photoconductor is of a value of 0.8 or less, and the light absorption degree at a 450 nm wavelength light beam is of a value of 1.0 or more. Hereafter, the multilayer type electrophotographic photoconductor of the first embodiment will be explained specifically.

1. Basic Configuration

As shown in FIG. 1A, a multilayer type electrophotographic photoconductor 10 of the present invention has a multilayer structure comprising a charge generating layer 12 containing a charge generating agent, and a charge transporting layer 13 containing a charge transporting agent laminated successively on a base member 11.

Moreover, as shown in FIG. 1B, opposite to the above-mentioned configuration, a multilayer type electrophotographic photoconductor 10' having a charge transporting layer 13 first laminated on a base member 11, and a charge generating layer 12 laminated on the charge transporting layer 13 may be employed.

However, since the charge generating layer 12 is thinner than the charge transporting layer 13, it is preferable to form the charge transporting layer 13 on the upper layer side for protecting the charge generating layer 12.

Moreover, as shown in FIG. 1C, a multilayer type electrophotographic photoconductor 10" having an intermediate layer 14 formed first on a base member 11, and then a charge generating layer 12 and the charge transporting layer 13 formed successively is preferable.

The reason thereof is that easy flow-in of the charge on the base member 11 side to the photoconductive layer side can be prevented as well as the adhesion property of the base member 11 and the photoconductive layer 15 can be improved by providing such an intermediate layer 14. Furthermore, even in the case the flatness of the base member 11 is not sufficient, the surface can be smoothed by providing the intermediate layer 14 so as to enable stable layer formation.

In the multilayer type electrophotographic photoconductors, the charge polarity on the surface is determined depending on the formation order of the charge generating layer 12 and the charge transporting layer 13, and the kind of the charge transporting agent used for the charge transporting layer. For example, in the configuration of FIG. 1B, in the case that a hole transporting agent such as an amine compound derivative or a stilbene derivative is used, a negative charge type multilayer type electrophotographic photoconductor is provided.

2. Base Member

The base member 11 shown in FIGS. 1A to 1C is not particularly limited as long as it is made of a conductive material. For example, a metal or a metal compound such as iron, aluminum, copper, tin, platinum, silver, vanadium, molybdenum, chromium, cadmium, titanium, nickel, palladium, indium, stainless steel and brass may be used.

Moreover, the above-mentioned metal materials may be deposited on a base member made of a laminated plastic material, or on a glass base member covered with aluminum iodide, tin oxide, indium oxide, or the like.

Moreover, particularly in the case of using aluminum as an element tube material, it is preferable to apply an anodized aluminum process on the surface. The reason thereof is that desired charge characteristics can be obtained by controlling the electric conductivity of the photoconductive layer and the base member by forming a predetermined insulation film on the conductive base member.

3. Charge Generating Layer (1) Light Absorption Characteristics

The charge generating layer 12 shown in FIG. 1 is a layer mainly containing a charge generating agent and a binder resin, which can be formed by producing a coating solution by dispersing the charge generating agent and the binder resin in a predetermined organic solvent and applying the same on the base member 11.

Moreover, in the present invention, the photoconductive layer has a light absorption degree at a 680 nm wavelength light beam of a value of 0.8 or less. It is preferable that the charge generating layer 12 in particular out of the photoconductive layer has such light absorption characteristics.

The reason thereof is that generation of the residual charge not contributing to the image formation can be restrained by appropriately controlling the sensitivity of the entire photoconductive layer by controlling in particular the light absorption degree at a 680 nm light beam close to the incident light beam wavelength in the charge generating layer sensitive to an incident light beam from the exposure light source out of the photoconductive layer. Moreover, generation of the exposure memory accompanied by the residual charge generation can also be restrained.

Figure 2:
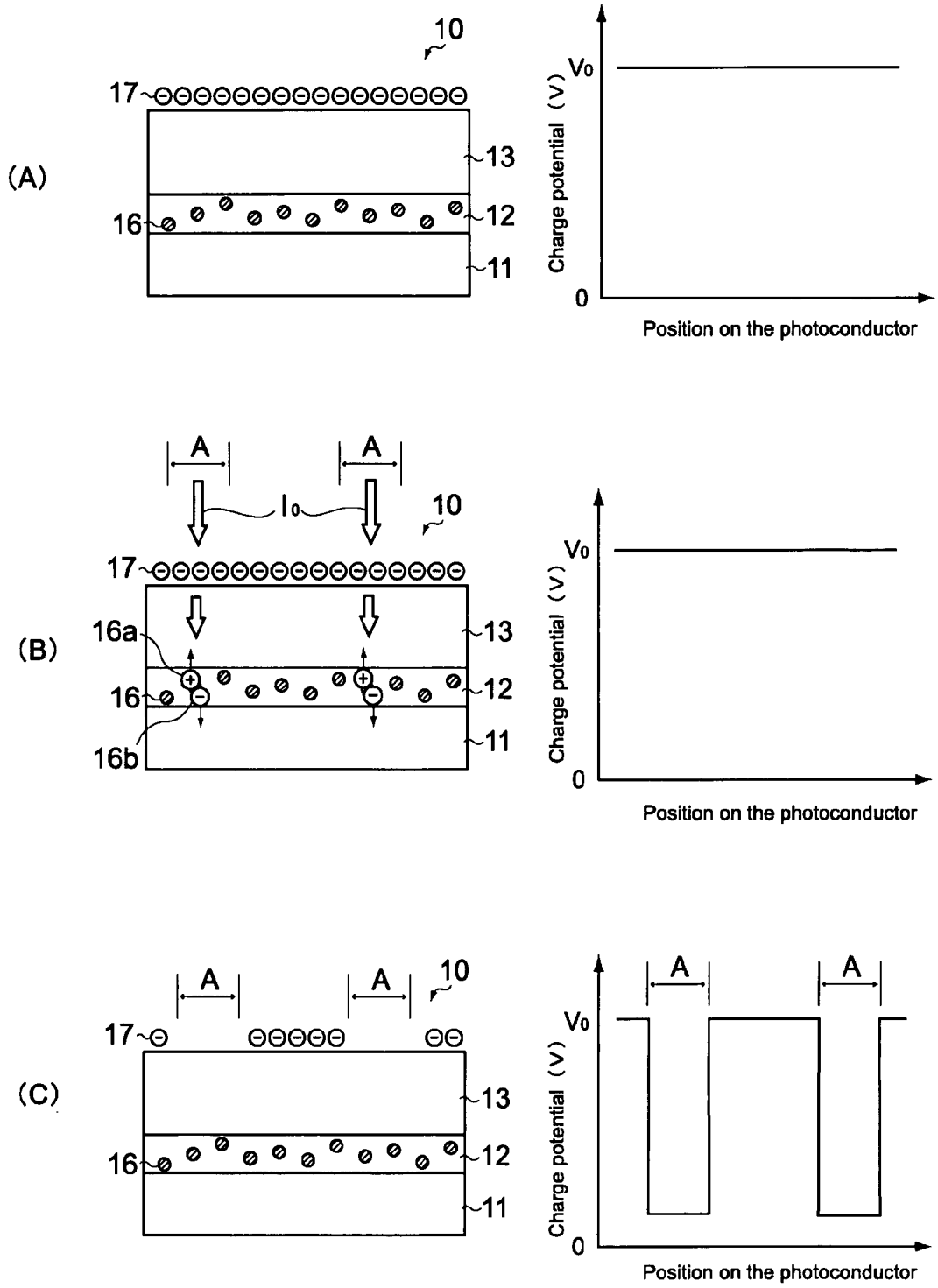
FIGS. 2A to 2C are a diagram for explaining the generation principle of the exposure memory.
Figure 3:
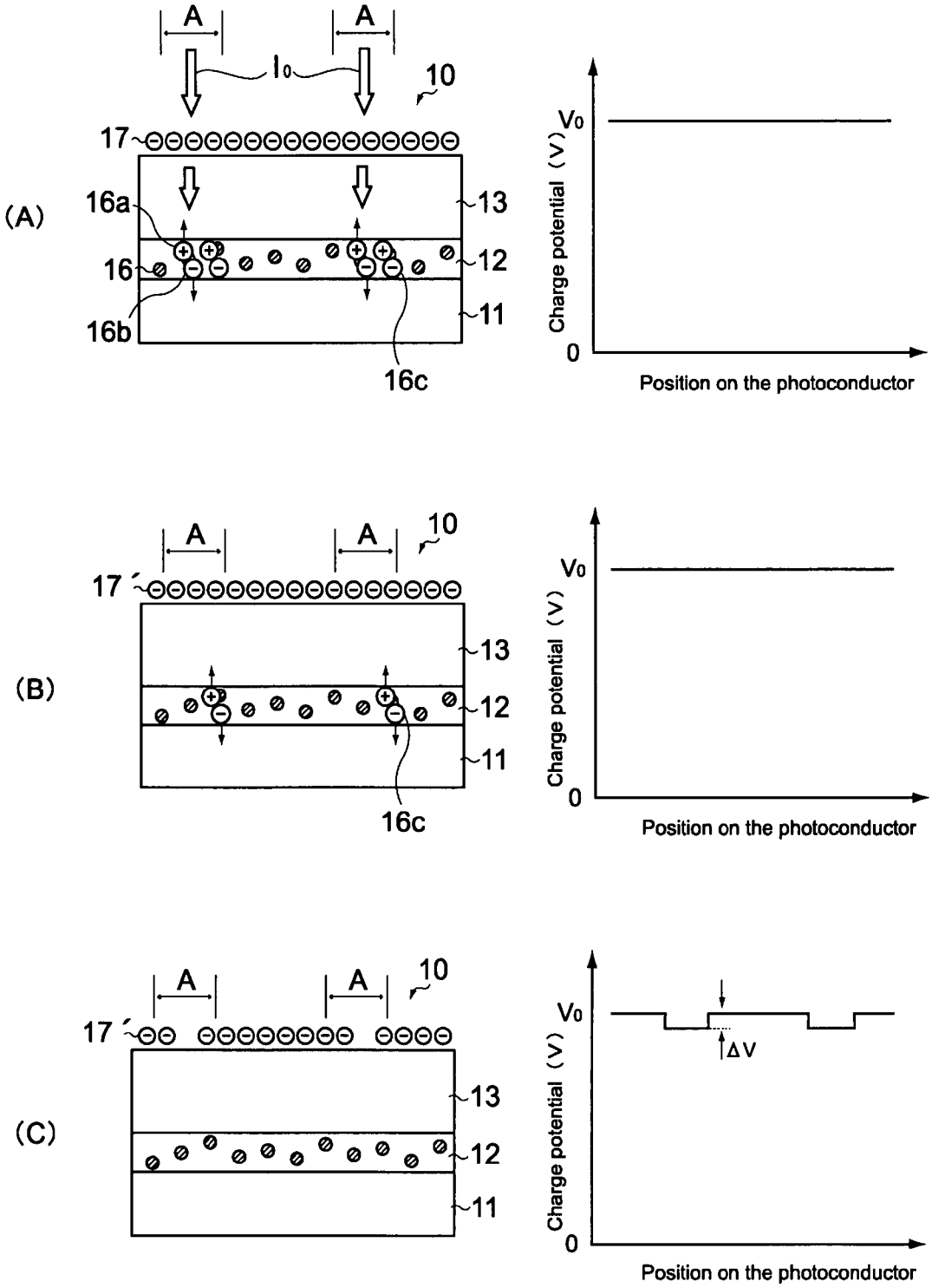
FIGS. 3A to 3C are a diagram for explaining the generation principle of the exposure memory (No. 2)

Here, with reference to FIGS. 2 to 4, the principle of the exposure memory reduction by the limitation of the light absorption degree at a 680 nm wavelength light beam in the charge generating layer will be explained.

First, FIG. 2A is a schematic cross-sectional view showing the state with the surface of a multilayer type electrophotographic photoconductor 10 comprising a charge generating layer 12 containing a charge generating agent 16 and a charge transporting layer 13 laminated successively on a base member 11 in a state charged to a predetermined potential and a charge potential graph thereof.

As shown in the figure, in the case the electrophotographic photoconductor 10 is charged using a charging means such as corona discharge, the surface charge 17 is distributed evenly on its surface so as to have the surface potential thereof as the potential $V_0$.

Then, FIG. 2B shows a state with a latent image formation by locally directing a 680 nm wavelength light beam from the state of FIG. 2A.

As shown in the figure, the charge generating agent 16 present in the exposure region A has the transition from the base state to the excited state by the collision with the incident light beam ($I_0$). As a result, the holes 16*a* excited so as to be a conductive ion and the electrons 16*b* to be paired with the holes 16*a* are generated, respectively. The holes 16*a* and the electrons 16*b* generated accordingly are moved in a predetermined direction by the influence of the electric field present in the photoconductive layer. That is, the holes 16*a* are bonded with the surface charge 17 present on the surface while moving in the charge transporting layer 13, and on the other hand, the electrons 16*b* flow into the earth through the base member 11.

As a result, as shown in FIG. 2C, the surface potential is locally lowered in the exposure region A wherein the holes 16*a* and the surface charge 17 are bonded on the surface for forming an electric gap so as to form a latent image.

However, in the process shown in FIG. 2B, in the case the electrons 16*b* and the holes 16*a* to be generated inside the charge generating layer 12 are formed excessively for some reason, the latent image formation is affected.

That is, as shown in FIG. 3A, at the time of locally directing a light beam of a predetermined wavelength in the exposure region A, the residual charge 16*c* remaining inside the charge generating layer 12 so as to be accumulated may be formed in addition to the electrons 16*b* to be moved to the base member side and the holes 16*a* to be moved to the surface side.

In such a case, as shown in FIG. 3B, at the time of charging the surface in the charging process of the next cycle, it is bonded with the surface charge 17' present on the surface in the stage before the exposure.

As a result, a slight potential difference ΔV is formed before the exposure, that is, in the stage before the latent image formation on the surface so as to generate the so-called exposure memory.

That is, by providing the light absorption degree in the charge generating layer to a predetermined value or less, the generation amount of the residual charge 16*c* can be reduced substantially so as to approximate the potential difference ΔV value to 0.

Next, the relationship between the light absorption degree value at a 680 nm wavelength light beam and the exposure memory will be explained.

Figure 4:
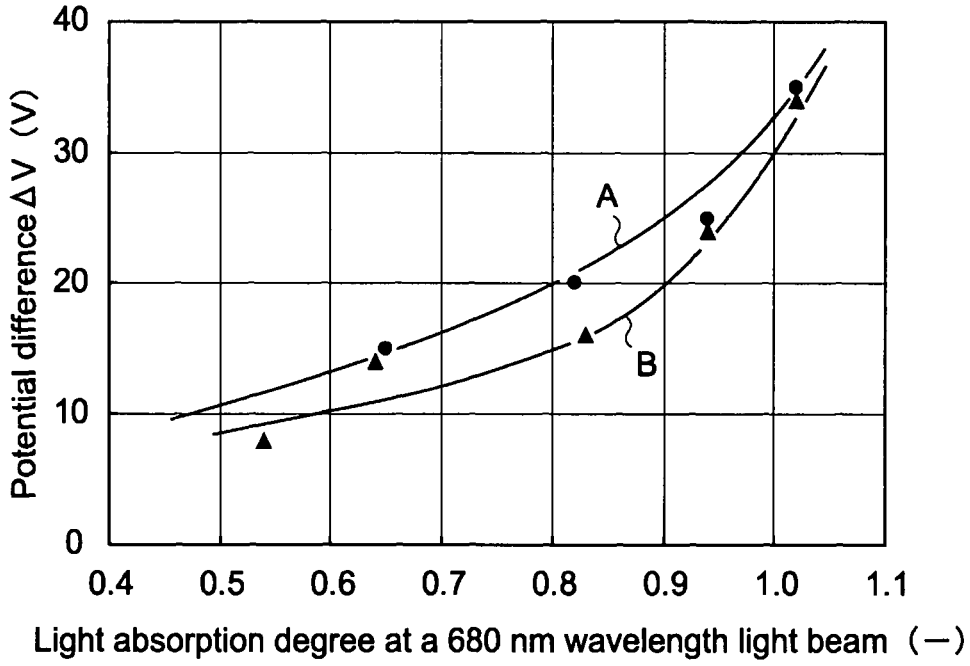
FIG. 4 is a characteristic graph showing the relationship between the light absorption degree at a 680 nm wavelength beam and the exposure memory.

FIG. 4 is a characteristic graph with the light absorption degree at a 680 nm wavelength light beam plotted in the lateral axis and the above-mentioned potential difference ΔV plotted in the vertical axis. Moreover, the characteristic curve A is a curve obtained at the time of using a titanyl phthalocyanine (CGM-1) to be described later as the charge generating agent and a hole transporting agent (HTM-1) as the charge transporting agent, with the content of the titanyl phthalocyanine changed.

Moreover, the characteristic curve B is a curb obtained at the time of using a hole transporting agent (HTM-6) different from that of the characteristic curve A.

As it is understood from the characteristic graphs, in both cases with the charge transporting agents, as the light absorption degree at a 680 nm wavelength light beam lowered by reducing the content of the charge generating agent, the potential difference ΔV formed in the surface potential of the photoconductive layer is lowered so as to restrain generation of the exposure memory.

However, in the case the light absorption degree value is excessively lowered, although the exposure memory is improved, due to the decline of the charge generating efficiency in the charge generating layer, the desired image formation may not be achieved. On the contrary, in the case the light absorption degree value is excessively high, depending on the kind of the photosensitive material to be used, or the like, still the exposure memory may be generated by the residual charge formation. Therefore, the range of the light absorption degree at a 680 nm wavelength light beam is preferably a value within a range of 0.5 to 0.8, and it is more preferably a value within a range of 0.6 to 0.75.

On the other hand, in general, control of the light absorption degree in the photoconductive layer to a predetermined value or less denotes the sensitivity decline in the photoconductive layer. Therefore, in the case the light absorption degree is lowered by reducing the content of the charge generating agent as the graph shown in FIG. 4, the sensitivity of the photoconductive layer is lowered accordingly so that the desired image characteristics may not be obtained.

Then, as a means for solving such a problem, a method of selectively using a charge transporting agent having a high charge mobility may be used, and it will be described in detail in the column of the charge transporting agent.

(2) Charge Generating Agent

The kind of the charge generating agent to be used for the charge generating layer is not particularly limited as long as the above-mentioned light absorption characteristics can be exhibited. For example, non metal phthalocyanine, oxotitanyl phthalocyanine, hydroxyl gallium phthalocyanine, chlorogallium phthalocyanine, a perylene pigment, a bisazo pigment, a dithiochetopyrolopyrol pigment, a non metal naphthalocyanine pigment, a metal naphthalocyanine pigment, a squaline pigment, a trisazo pigment, an indigo pigment, an azulenium pigment, a cyanine pigment, or the like may be used. These may be used either alone by one kind or in a combination of two or more kinds.

Among these examples, in particular, since a photoconductor having a sensitivity at 700 nm or more wavelength range is required for a digital optical system image forming apparatus such as a laser beam printer and a facsimile using a semiconductor laser, or the like as the light source, for example, a phthalocyanine based pigment such as non metal phthalocyanine and oxotitanyl phthalocyanine may be used. On the other hand, since a photoconductor having a sensitivity in a visual range is required for an analog optical system image forming apparatus using a white light source, such as a halogen lamp, for example, a perylene pigment, a bisazo pigment, or the like may be used.

Moreover, particularly in the case of using a titanyl phthalocyanine as the charge generating agent, it is preferable to use a titanyl phthalocyanine crystal without a peak in the Bragg angle of 2θ±0.2°=7.4° and 26.2° as its crystal characteristics and without a peak within a range of 50 to 400° C. other than the peak accompanied by the vaporization of the adsorbed water in the differential scanning calorie analysis.

The reason thereof is that since a titanyl phthalocyanine having such crystal characteristics and thermal characteristics has the excellent crystalline property, stable charge generation ability can be obtained at a predetermined wavelength. Moreover, since it has also the excellent thermal stability, desired electric characteristics can be obtained stably without suffering the influence of the storage environment in a coating solution state, the work environment in a coating process, or the like. As to the evaluation method for the crystalline characteristics, an X ray diffraction analysis method may be used with a CuKα characteristic X ray as the kind of its beam.

Moreover, as another aspect of the crystalline characteristics and the thermal characteristics of the titanyl phthalocyanine, it is preferable to use a titanyl phthalocyanine crystal having a peak in the Bragg angle of 2θ±0.2°=27.2° as its crystal characteristics and having one peak within a range of 270 to 400° C. other than the peak accompanied by the vaporization of the adsorbed water in the differential scanning calorie analysis as its thermal characteristics.

The reason thereof is that since such a titanyl phthalocyanine has the crystal phase transition point to the α type or the β type accompanied by the heat absorption is shifted to the high temperature side compared with the conventional ones, even in the case of a long term storage in a coating solution state, the exposure memory and the photo memory can be restrained effectively without generation of the crystal transition.

One peak to be within a range of 270 to 400° C. other than the peak accompanied by the vaporization of the adsorbed water is more preferably within a range of 290 to 400° C., and it is further preferably within a range of 300 to 400° C.

Moreover, in addition to such crystal characteristics, it is preferable that it does not have a peak in the Bragg angle of 2θ±0.2°=26.2°, and furthermore, it is not preferable that it does not have a peak in the Bragg angle of 2θ±0.2°=7.4°.

The reason thereof is that with a titanyl phthalocyanine having such crystal characteristics, the content ratio of a titanyl phthalocyanine having a peak in the Bragg angle of 27.2° is increased so that a highly sensitive charge generating layer may be produced with a good reproductivity.

Moreover, as to the structure of the titanyl phthalocyanine to be used here, a compound having a structure formula represented by the following general formula (1) may be used. Furthermore, a non substituted titanyl phthalocyanine compound represented by the following formula (2) may be used.

(1)

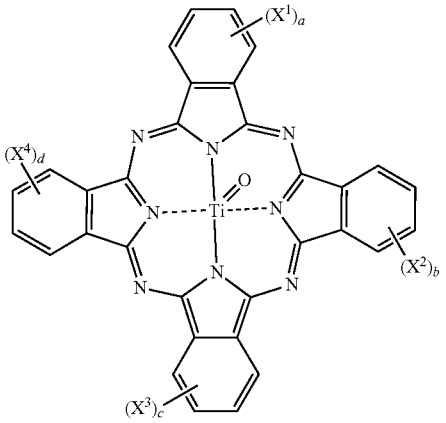

(In the general formula (1), $X^1$, $X^2$, $X^3$, and $X^4$ are a substitutent, which may either be same or different, representing a hydrogen atom, a halogen atom, an alkyl group, an alkoxy group, a cyano group or a nitro group, and the repetition numbers a, b, c and d each represents an integer of 1 to 4, which may either be same or different.)

(2)

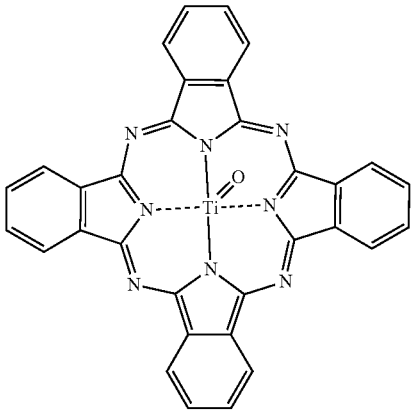

(CGM-1)

The content of the charge generating agent in the charge generating layer is preferably a value within a range of 30 to 80% by weight with respect to the total amount of the charge generating layer.

The reason thereof is that with a value in such a range, the light absorption degree at a 680 nm wavelength light beam in a charge generating layer of a more preferably film thickness 0.2 to 1 μm can easily be controlled in a predetermined range.

However, in the case the content is too low, the image characteristics may be lowered without sufficiently obtaining a charge generating efficiency. On the contrary, in the case the content is too high, although the charge generating efficiency is improved, since the ratio of the binder resin is reduced, due to the deterioration of the interlayer binding property, deterioration of the sensitivity and the electric characteristics, and furthermore, peel off of the photoconductive layer may be generated. Therefore, the content of the charge generating agent is preferably a value within a range of 30 to 80% by weight, and it is more preferably a value within a range of 50 to 75% by weight.

(3) Binder Resin

Moreover, as the binder resin, a polycarbonate resin of a bisphenol A type, a bisphenol Z type, a bisphenol C type, or the like, a polyester resin, a methacrylic resin, an acrylic resin, a polyvinyl chloride resin, a polystyrene resin, a polyvinyl acetate resin, a polyvinyl butylal resin, a styrene-butadiene copolymer resin, a vinylidene chloride-acrylonitrile copolymer resin, a vinyl chloride-vinyl acetate-maleicanhydride resin, a silicone resin, a silicone-alkyd resin, a phenol-formaldehyde resin, N-vinyl carbazol, or the like may be used. These may be used alone by one kind or as a combination of two or more kinds.

(4) Film Thickness

The film thickness of the charge generating layer is not particularly limited as long as the above-mentioned light absorption characteristics can be exhibited. In general, it is preferably a value within a range of 0.01 to 5.0 μm.

The reason thereof is that the light absorption degree at a 680 nm wavelength light beam in the charge generating layer can easily be adjusted to a value of 0.8 or less by optionally adjusting the film thickness of the charge generating layer in such a range.

Therefore, it is more preferable to provide the film thickness of the charge generating layer to a value within a range of 0.2 to 1 μm.

4. Charge Transporting Layer (1) Light Absorption Characteristics

The charge transporting layer 13 shown in FIG. 1 is a layer containing mainly a charge transporting agent and a binder resin. It can be formed by producing a coating solution by dispersing the charge transporting agent and the binder resin in a predetermined organic solvent, and applying the same onto the base member 11 with the charge generating layer 12 formed.

Moreover, in the present invention, the photoconductive layer has the light absorption degree at a 450 nm wavelength light beam of a value of 1.0 or more. It is preferable that the charge transporting layer 13 out of the photoconductive layer in particular has such light absorption characteristics.

The reason thereof is that since a 450 nm wavelength light beam included in the wavelength range contributing to the charge generation is absorbed by the charge transporting layer 13 provided on the upper layer side of the charge generating layer 12, the wavelength selection property can be provided to the charge transporting layer 13.

Figure 5:
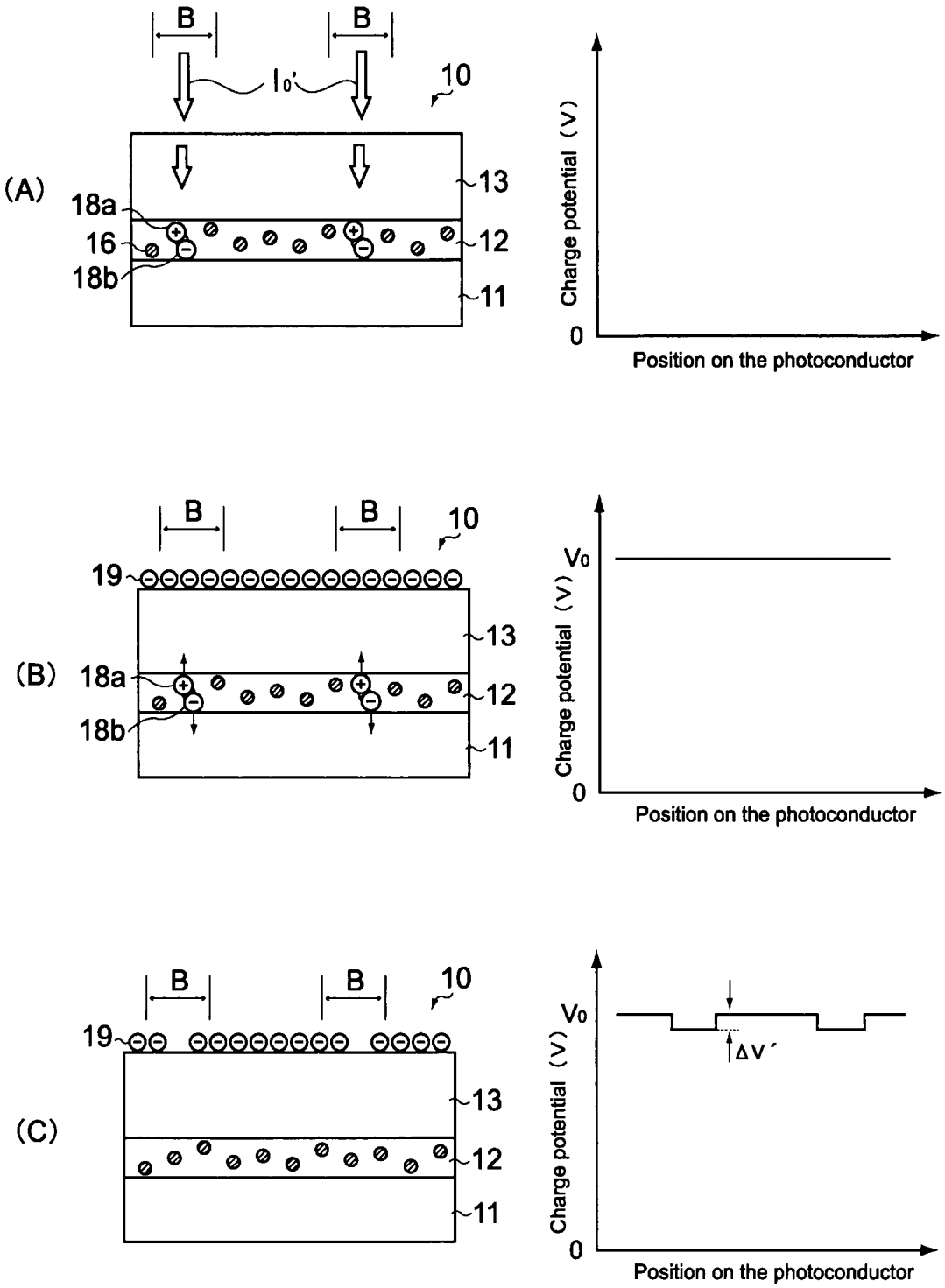
FIGS. 5A to 5C are a diagram for explaining the generation principle of the photo memory.

Here, with reference to FIGS. 5 to 7, the principle of the photo memory reduction by limiting the light absorption degree at a 450 nm wavelength light beam in the charge transporting layer will be explained.

First, FIG. 5A is a schematic cross-sectional view showing the state with the surface of the multilayer type electrophotographic photoconductor 10 comprising the charge generating layer 12 containing the charge generating agent 16 and the charge transporting layer 13 laminated successively on the base member 11 exposed to the external beam such as the solar beam and the interior lamp, and the charge potential graph at the time.

As shown in the figure, the external beam ($I_0'$) incident from the surface side of the photoconductive layer passes through the charge transporting layer 13 in the irradiation region B so as to reach at the charge generating layer 12. At the time, the charge generating agent 16 present in the irradiation region B is excited by the external beam so as to generate the holes 18*a* and the electrons 18*b*.

Then, FIG. 5B shows the state charged so as to have the surface potential to be $V_0$ using a predetermined charging means form the state of FIG. 5A.

As shown in the figure, the surface charge 19 is distributed evenly on the electrophotographic photoconductor surface. Immediately thereafter, the holes 18*a* start to move to the photoreceptor layer surface side by the electric attraction from the surface charge 19.

As a result, as shown in FIG. 5C, the electric gap ΔV' with the surface potential locally lowered is formed in the irradiation region B so as to generate the so-called photo memory.

Then, according to the present invention, by providing the photo absorption characteristics at a 450 nm wavelength light beam to the charge transporting layer 13, the 450 nm wavelength light beam is prevented from reaching to the charge generating layer 12 so as to prevent production of the charge excited by the external light beam.

Then, the relationship between the light absorption degree value at a 450 nm wavelength light beam and the photo memory will be explained.

Figure 6:
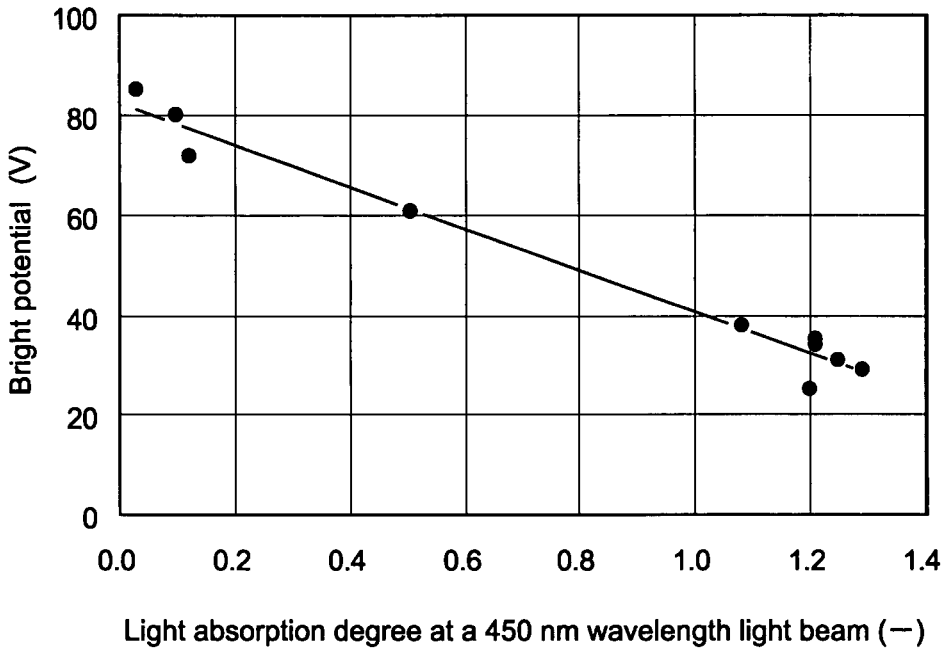
FIG. 6 is a characteristic graph showing the relationship between the absorption degree at a 450 nm wavelength beam and the sensitivity.
Figure 7:
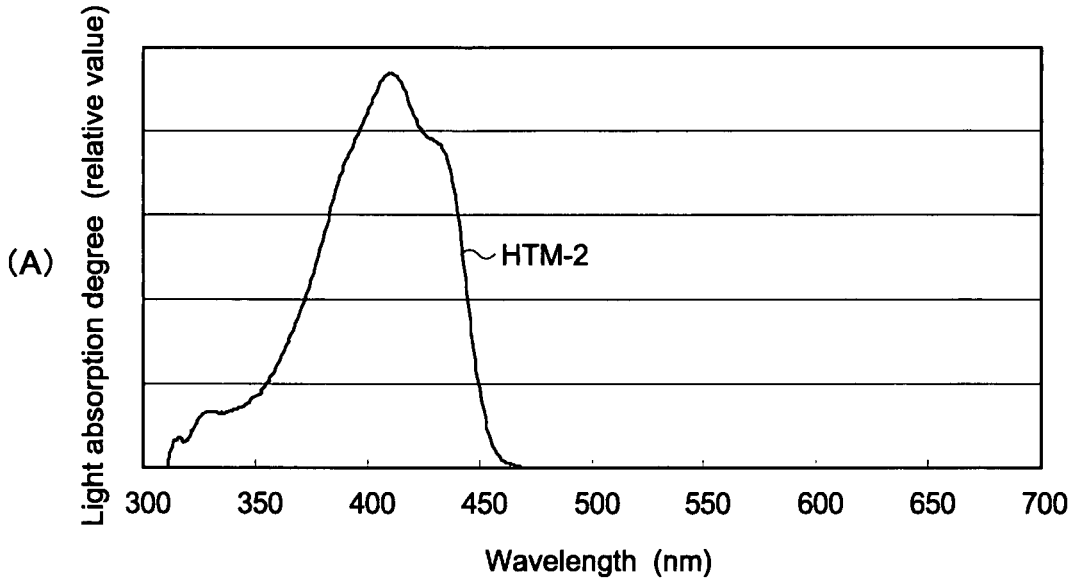
FIGS. 7A to 7B are a characteristic graph showing the absorption spectra of a hole transporting agent (HTM-2, HTM-6) in a liquid state.
Figure 7:
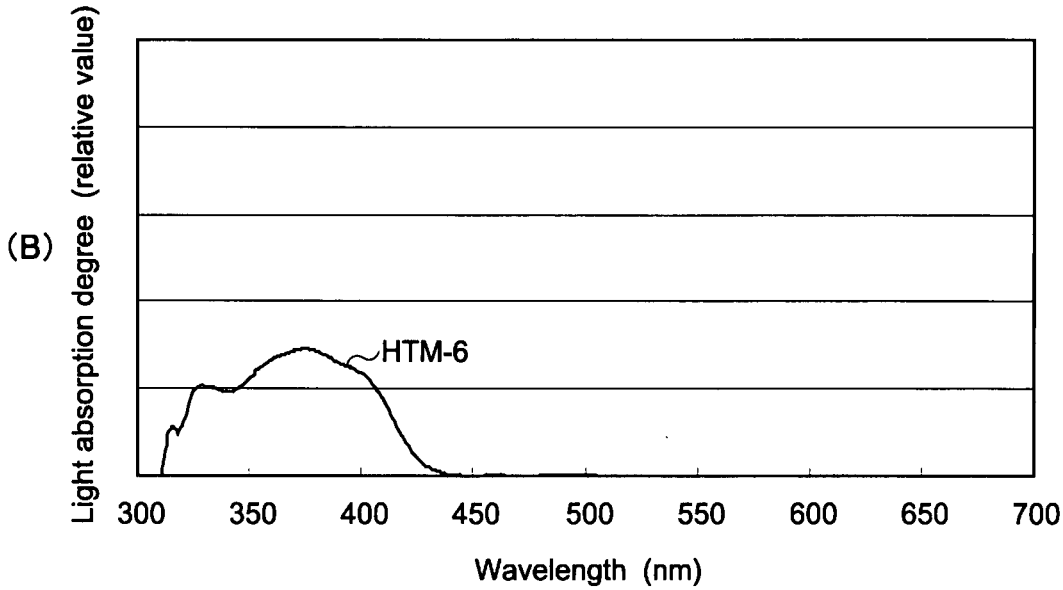

FIG. 6 is a characteristic graph obtained by plotting the light absorption degree at a 450 nm wavelength light beam in the lateral axis and the bright potential (V) as the indicator of the sensitivity of the photoconductive layer plotted in the vertical axis. Moreover, the characteristic graph of FIG. 6 is of data obtained using a titanyl phthalocyanine (CGM-1) as the charge generating agent and hole transporting agents with different light absorption characteristics (HTM-1 to 10) as the charge transporting agent.

As shown in the figure, as the light absorption degree at a 450 nm wavelength light beam made higher, the bright potential value is reduced, that is, the sensitivity is raised so that the photo memory generation is reduced as well. However, if the light absorption degree value is excessively large, the absolute amount of the light beam reaching to the charge transporting layer is reduced so as to lower the sensitivity on the contrary so that the photo memory generation may be induced. Therefore, the range of the light absorption degree at a 450 nm wavelength light beam is preferably a value within a range of 1.0 to 1.5, and it is more preferably a value within a range of 1.1 to 1.4.

The bright potential here denotes the charge potential after exposure of the exposure region at the time of exposing the surface of a photoconductor charged to a predetermined potential, and it is ideally a value showing 0 (V). That is, with a lower bright potential, the sensitivity is high, and thus it denotes little generation of the image memory such as the photo memory.

(2) Charge Transporting Agent

Moreover, as a means for adjusting the light absorption characteristics of a charge transporting layer, a method of selecting the kind of the charge transporting agent to be included in the charge transporting layer may be used. As to the selection criteria, it is not particularly limited as long as it is a charge transporting agent having the absorption in the vicinity of a 450 nm wavelength. For example, as a hole transporting agent, a bendizine based compound, a phenylene diamine based compound, a naphtylene diamine based compound, a phenantolylene diamine based compound, an oxadiazol based compound (such as 2,5-di(4-methyl amino phenyl)-1,3,4-oxadiazol), a styryl based compound (such as 9-(4-diethyl amino styryl) anthracene), a carbazol based compound (such as poly-N-vinyl carbazol), an organic polysilane compound, a pyrazoline based compound (such as 1-phenyl-3-(p-dimethyl amino phenyl) pyrazoline), a hydrazone based compound, a triphenyl amine based compound, an indole based compound, an oxazole based compound, an isooxazole based compound, a thiazol based compound, a thiadiazol compound, an imidazol based compound, a pyrazole based compound, a triazole based compound, a butadiene based compound, a pyrene-hydrazone based compound, an acrolein based compound, a carbazol-hydrazone based compound, a quinoline-hydrazone based compound, a stilbene-hydrazone based compound, a diphenylene diamine based compound, or the like may be used. These may be used either alone by one kind or as a combination of two or more kinds.

Moreover, among these hole transporting agents, it is particularly preferable to use a hole transporting agent represented by the following general formulae (3) to (6). As a specific example, it is preferable to use a hole transporting agent represented by the following formulae (7) and (8) (HTM-1 and HTM-2).

The reason thereof is that since the hole transporting agents have the excellent light absorption characteristics from the vicinity of the 450 nm wavelength over the visible light region, the light absorption degree at a 450 nm wavelength light beam can easily be controlled to 1.0 or more so that the photo memory can effectively be restrained. Moreover, since these hole transporting agents have a relatively high charge mobility, even in the case of controlling the light absorption degree to a low level in the charge generating layer, a predetermined sensitivity level can be maintained by compensating the sensitivity decline accompanied thereby.

(3)

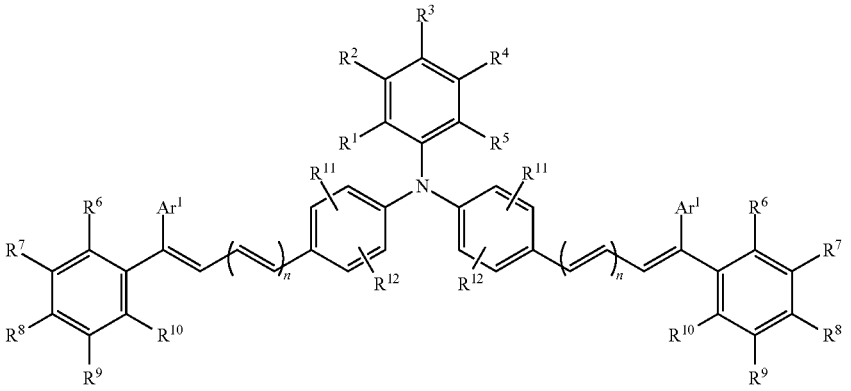

(In the general formula (3), $R^1$ to $R^{12}$ are each independently a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, or —$OR^{13}$ ($R^{13}$ is an alkyl group having 1 to 10 carbon atoms, a perfluoroalkyl group, or an aryl group having 6 to 30 carbon atoms), $Ar^1$ is a hydrogen atom, a substituted or unsubstituted alkyl group having 1 to 12 carbon atoms, or a substituted or unsubstituted aryl group having 6 to 30 carbon atoms, and n is an integer of 0 to 2).

(4)

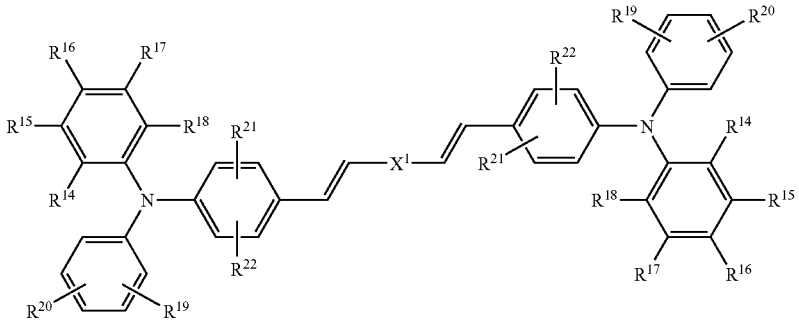

(In the general formula (4), $X^1$ is a substituted or unsubstituted arylene group having 6 to 30 carbon atoms, an unsaturated hydrocarbon group having an aryl group having 6 to 30 carbon atoms, or a condensed polycyclic hydrogen group having 10 to 30 carbon atoms, $R^{14}$ to $R^{22}$ are each independently a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, or —$OR^{23}$ ($R^{23}$ is an alkyl group having 1 to 10 carbon atoms, a perfluoroalkyl group, or an aryl group having 6 to 30 carbon atoms), $R^{14}$ to $R^{18}$, $R^{19}$ and $R^{20}$, $R^{21}$ and $R^{22}$ may form a saturated or unsaturated ring by linking two substitutents with each other, or $R^{16}$ and $R^{20}$ may be a substitutent of the following general formula (4') in addition to the above-mentioned substitutents).

(4')

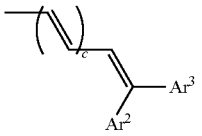

(In the general formula (4'), $Ar^2$, $Ar^3$ are a hydrogen atom, a substituted or unsubstituted alkyl group having 1 to 12 carbon atoms, or a substituted or unsubstituted aryl group having 6 to 30 carbon atoms, and c is an integer of 0 to 2.)

(5)

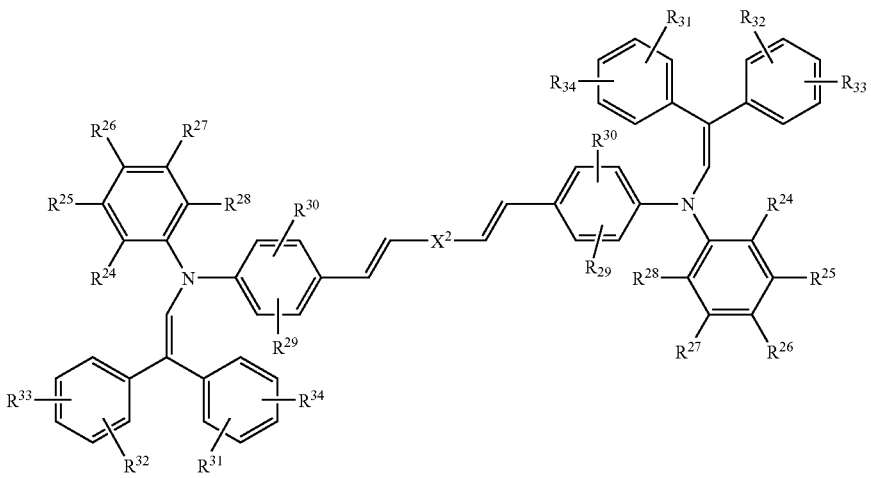

(In the general formula (5), $X^2$ is a substituted or unsubstituted arylene group having 6 to 30 carbon atoms, an unsubstituted hydrocarbon group having an aryl group having 6 to 30 carbon atoms, or a condensed polycyclic hydrogen group having 10 to 30 carbon atoms, $R^{24}$ to $R^{34}$ each independently are a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, or —$OR^{35}$ ($R^{35}$ is an alkyl group having 1 to 10 carbon atoms, a perfluoroalkyl group, or an aryl group having 6 to 30 carbon atoms), $R^{24}$ to $R^{28}$, $R^{29}$ and $R^{30}$, $R^{31}$ and $R^{34}$, and $R^{32}$ and $R^{33}$ may form a saturated or unsaturated ring by linking two substitutents with each other, or $R^{26}$ may be a substitutent of the following formula in addition to the above-mentioned substitutents).

(5')

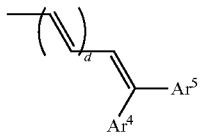

(In the general formula (5'), $Ar^4$, $Ar^5$ are a hydrogen atom, a substituted or unsubstituted alkyl group having 1 to 12 carbon atoms, or a substituted or unsubstituted aryl group having 6 to 30 carbon atoms, and d is an integer of 0 to 2.)

(6)

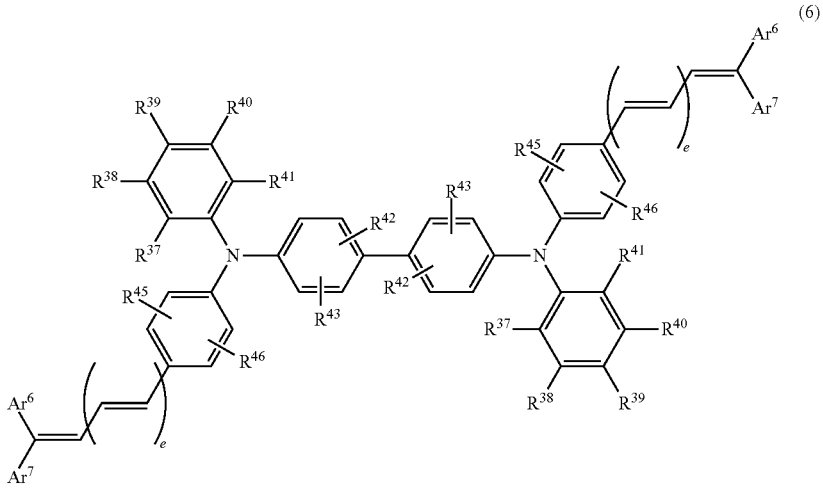

(In the general formula (6), $R^{37}$ to $R^{46}$ are each independently a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, or —$OR^{47}$ ($R^{47}$ is an alkyl group having 1 to 10 carbon atoms, a perfluoroalkyl group, or an aryl group having 6 to 30 carbon atoms), $R^{37}$ to $R^{41}$, $R^{42}$ and $R^{43}$, $R^{45}$ and $R^{46}$ may form a saturated or unsaturated ring by linking two substitutents with each other, furthermore, $Ar^6$, $Ar^7$ are a hydrogen atom, a substituted or unsubstituted alkyl group having 1 to 12 carbon atoms, or a substituted or unsubstituted aryl group having 6 to 30 carbon atoms, and e is an integer of 0 to 2.)

(7)

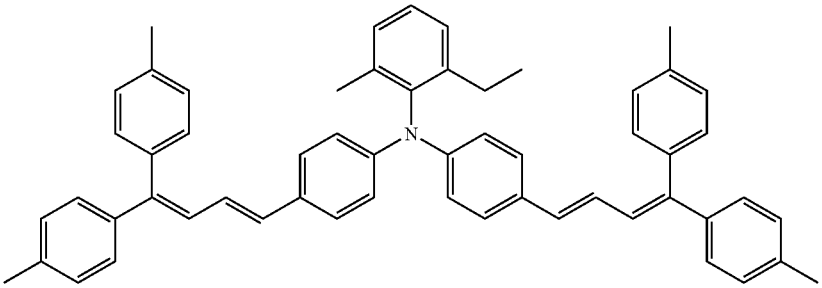

(HTM-1)

(8)

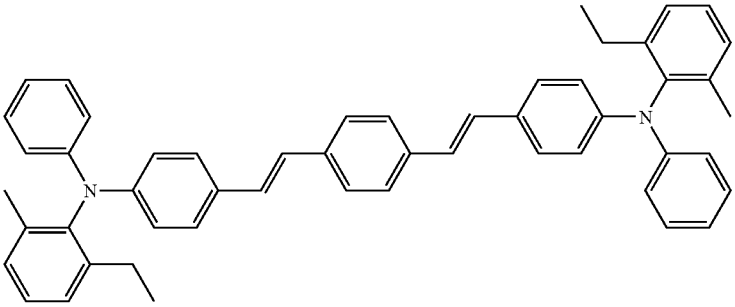

(HTM-2)

In particular, since the hole transporting agent represented by the HTM-2 has the absorption spectrum as shown in FIG. 7A, it may be used suitably as the charge transporting agent used in the present invention. FIG. 7A shows an absorption spectrum at the time of measuring the light absorption degree by dispersing the hole transporting agent (HTM-2) in a predetermined organic solvent, with the absorption wavelength (nm) plotted in the lateral axis and the light absorption degree (absolute value) plotted in the vertical axis. Moreover, FIG. 7B shows an absorption spectrum of a different hole transporting agent (HTM-6) for the comparison.

The hole transporting agent (HTM-2) shown in FIG. 7A has the absorption peak in the vicinity of the 400 nm wavelength and it also has the absorption in the vicinity of 450 nm from the ultraviolet region to the visible light region. Therefore, it is a hole transporting agent capable of absorbing the external light beam having the visible light region so as to effectively prevent generation of the photo memory.

On the other hand, the hole transporting agent (HTM-6) shown in FIG. 7B has the absorption peak in the vicinity of the 380 nm wavelength and it also has the absorption wavelength region locally substantially in the ultraviolet region. Therefore, in particular, it does not have sufficient light absorption characteristics to an external light beam having a visible light region so that it is not suitable for a hole transporting agent for effectively preventing generation of the photo memory.

Therefore, in the case of adopting a method of selecting a hole transporting agent as a method for controlling the light absorption degree at a 450 nm wavelength light beam, the material can be selected efficiently by referring to its absorption spectrum.

Figure 8:
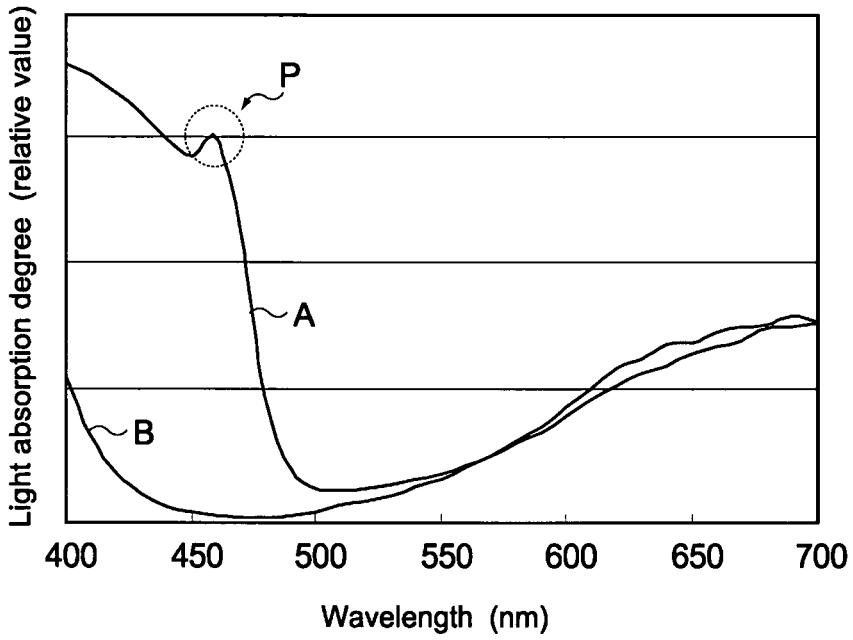
FIG. 8 is a characteristic graph showing the absorption spectra of a hole transporting agent (HTM-2) in a layer state.

Moreover, FIG. 8 shows the light absorption spectrum with respect to the multilayer type electrophotographic photoconductor using the hole transporting agent (HTM-2) shown in FIG. 7A with the wavelength (nm) plotted in the lateral axis and the light absorption degree (relative value) plotted in the vertical axis. Moreover, the characteristic curve A in the figure denotes the light absorption curve of the multilayer type photoconductive layer with the intermediate layer, the charge generating layer and the charge transporting layer successively laminated, and the characteristic curve B denotes the light absorption curve of the charge generating layer alone.

As shown in the figure, in the characteristic curve A, the hole transporting agent (HTM-2) shows the substantially same tendency as the measurement result in the solution state shown in FIG. 7A. As the difference therebetween, presence of the local maximum peak shown in the region P in the vicinity of 450 nm may be used.

The local maximum peak is a unique light absorption characteristic generated as a result of the phase transition from the solution state to the solid state. Owing to the presence of the local maximum peak, the light beam in the vicinity of 450 nm can be absorbed further effectively so that an electrophotographic photoconductor with the generation of the photo memory restrained can be provided.

Moreover, the charge transporting agent used for the charge generating layer of the present invention may contain an electron transporting agent. In this case, it is not particularly limited as long as it has the above-mentioned light absorption characteristics. For example, a benzoquinone based compound, a diphenoquinone based compound, a naphthoquinone based compound, marononitrile, a thiopyrane based compound, tetracyano ethylene, 2,4,8-trinitrothioxantone, a fluorenone based compound [such as 2,4,7-trinitro-9-fluorenone], dinitrobenzene, nitroanthracene, dinitroacrydine, nitroanthraquinone, succinic anhydride, maleic anhydride, dibromomaleic anhydride, a 2,4,7-trinitrofluorenone imine based compound, an ethylated nitrofluorenone imine based compound, a triptoanthrene based compound, a triptoanthrene imine based compound, an azafluorenone based compound, a dinitropyridoquinazoline based compound, a thioxanthene based compound, a 2-phenyl-1,4-benzoquinone based compound, a 2-phenyl-1,4-naphthoquinone based compound, a 5-12-naphthacene quinine based compound, an α-cyanostilben based compound, a 4,'-nitrostilben based compound, an electron attracting compound such as a salt of a negative ion radical of a benzoquinone based compound and a cation, or the like may preferably be used. These may be used either alone by one kind or in a combination of two or more kinds.

(3) Ionizing Potential

Moreover, it is preferable that the charge transporting agent used in the present invention has the ionizing potential of a value of 5.3 eV or more.

The reason thereof is that the potential difference with respect to the charge generating agent can be controlled in a predetermined range by having the value in such a range so that the charge mobility can substantially be improved. Therefore, stagnation of the charge in the charge generating layer can be prevented so that an electrophotographic photoconductor with the generation of the exposure memory or the photo memory restrained can be provided by effectively removing the residual charge not contributing to the latent image formation.

Next, the relationship between the ionizing potential and the exposure memory will be explained.

Figure 9:
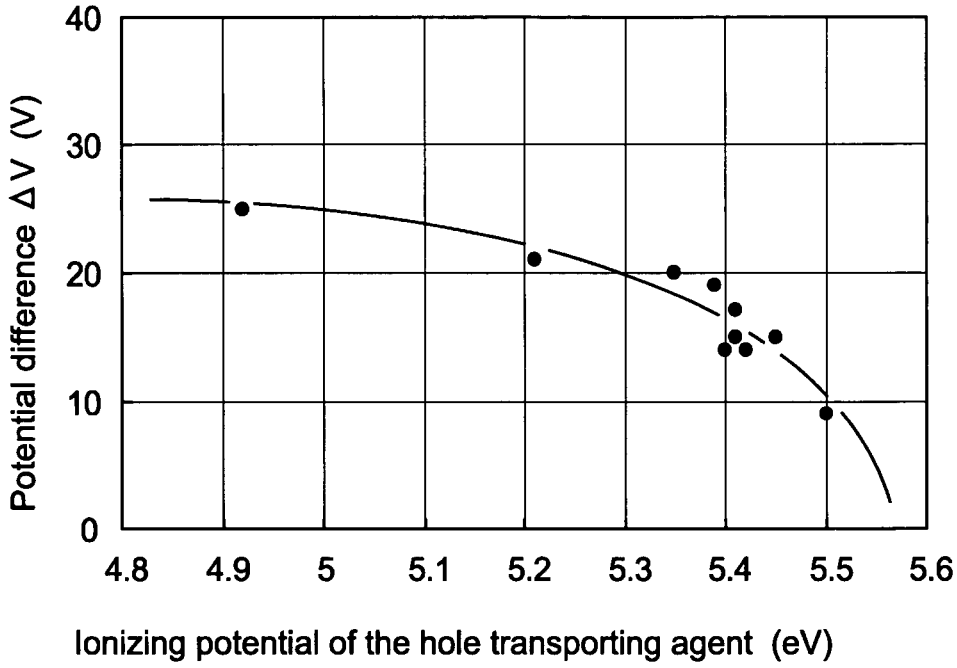
FIG. 9 is a characteristic graph showing the relationship between the ionizing potential of a hole transporting agent and the exposure memory.

FIG. 9 is a characteristic graph with the ionizing potential (eV) of the hole transporting agent plotted in the lateral axis and the potential difference ΔV as the indicator of the exposure memory plotted in the vertical axis. Moreover, the characteristic graph of FIG. 9 is a graph obtained by using the titanyl phthalocyanine (CGM-1) as the charge generating agent and the hole transporting agents (HTM-1 to 10) having different ionizing potentials as the charge transporting agent.

As shown in the figure, with a hole transporting agent having a larger ionizing potential value, the amount of the generated exposure memory can be reduced.

However, in the case the value of the ionizing potential is too large, although the exposure memory is reduced, due to enlargement of the difference with respect to the ionizing potential of the charge generating agent, the charge transporting efficiency from the charge generating layer to the charge transporting layer is lowered. Moreover, on the contrary, in the case the value of the ionizing potential is too small, due to the decline of charge transporting ability in the charge transporting layer, the residual charge can hardly be discharged so as to lead to the generation of the exposure memory or the photo memory.

Therefore, it is preferable that the range of the ionizing potential is a value within a range of 5.35 to 6.0 eV, and it is more preferably a value within a range of 5.4 to 5.6 eV.

(4) Mobility

In the present invention, in the case a hole transporting agent is used as the charge transporting agent, it is preferable that its mobility is $5\times10^{-6}$ ($cm^2/V\cdot sec$) or more in the condition of the 30% by weight concentration and the electric field strength of $3\times10^5$ V/cm.

The reason thereof is that according to the value in such a range, even in the case the light absorption degree in the charge generating layer is limited to a predetermined value or less, the sensitivity decline can be compensated by the charge moving ability in the charge transporting layer for maintaining the sensitivity of the photoconductive layer to a predetermined level as a result.

Figure 10:
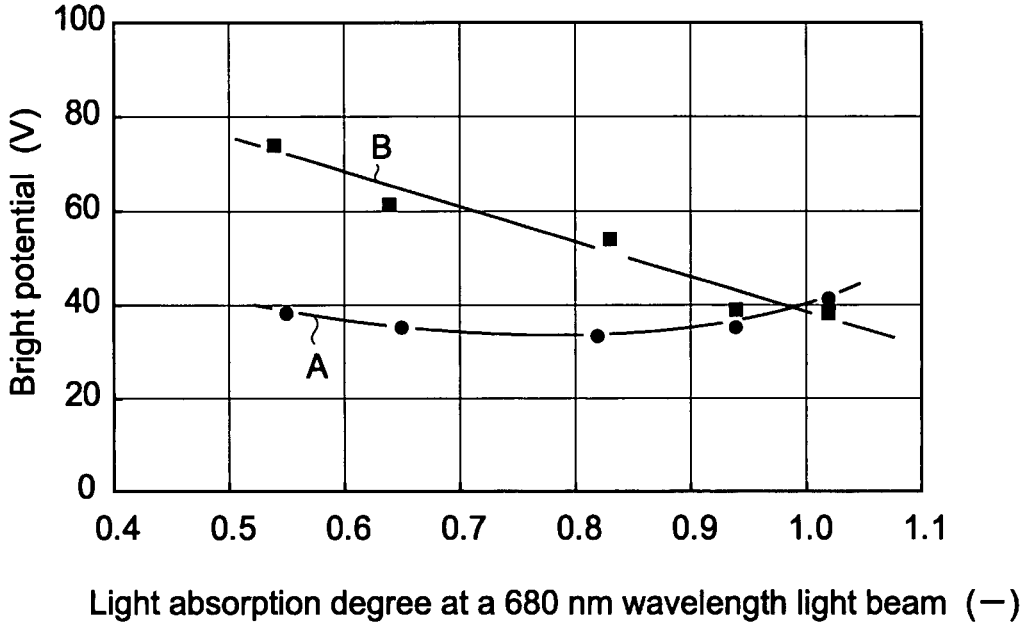
FIG. 10 is a characteristic graph showing the relationship between the light absorption degree at a 680 nm wavelength beam and the sensitivity.

Here, the relationship between the mobility of the hole transporting agent and the sensitivity of the photoconductive layer will be explained with reference to FIG. 10. FIG. 10 is a characteristic graph with the light absorption degree at a 680 nm wavelength light beam plotted in the lateral axis and the bright potential (V) as the indicator of the sensitivity of the photoconductive layer plotted in the vertical axis. Moreover, the characteristic curve A is a sensitivity curve obtained at the time of forming with a high mobility hole transporting agent (HTM-1) and the characteristic curve B is a sensitivity curve obtained at the time of forming with a low mobility hole transporting agent (HTM-6).

As shown in the figure, in the case of using a low mobility hole transporting agent as shown by the characteristic curve B, the bright potential tends to be raised as the light absorption degree becomes lower so as to lower the sensitivity.

As mentioned above, this is the sensitivity lowering phenomenon generated inevitably by lowering the light absorption degree in the charge generating layer showing the common tendency to be observed at the time of optionally selecting the hole transporting agent.

On the other hand, with a high mobility hole transporting agent (HTM-1) used suitably in the present invention, as shown by the characteristic curve A, even in the case of lowering the light absorption degree, the sensitivity can be maintained at certain level by preventing the rise of the bright potential to a predetermined value or more.

However, in the case the mobility is too high, although the sensitivity is raised, the charge stability of the electrophotographic photoconductor surface may be lowered. Moreover, on the contrary, in the case the mobility is too low, depending on the constituent material, or the like, the sensitivity may not be obtained sufficiently.

Therefore, it is preferable that the mobility range is a value within a range of $5\times10^{-6}$ to $5\times10^{-4}$ ($cm^2/(V\cdot sec)$), and it is more preferably a value within a range of $1\times10^{-5}$ to $1\times10^{-4}$ ($cm^2/(V\cdot sec)$).

(5) Photo Response Property

Moreover, as to the photo response property of the electrophotographic photoconductor used in the present invention, it is preferable that the time needed for the attenuation of the charge potential to 95% of the potential width ($V_1$-$V_2$) (95% attenuation time) is 10 msec or less with the premise that the initial charge potential of the multilayer type electrophotographic photoconductor is $V_1$ (V) and the charge potential after passage of 300 msec after the exposure is $V_2$ (V).

The reason thereof is that with an electrophotographic photoconductor having such a sensitivity, even in the case the light absorption degree at a 680 nm wavelength light beam is controlled to a predetermined value or less, a predetermined sensitivity characteristic can be maintained so that an electrophotographic photoconductor having the excellent photo response property can be produced stably.

Here, the relationship between the photo response property and the exposure memory will be explained with reference to FIG. 11.

Figure 11:
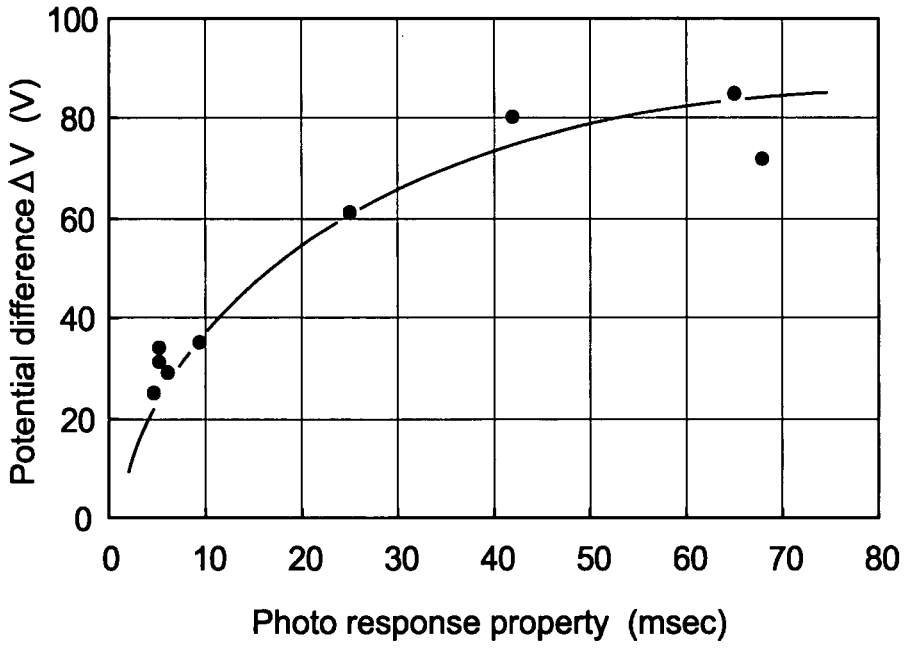
FIG. 11 is a characteristic graph showing the relationship between the photo response property and the exposure memory.

FIG. 11 is a characteristic graph with the 95% attenuation time in the above-mentioned conditions plotted in the lateral axis and the generated exposure memory, that is, the potential difference ΔV in FIG. 3C plotted in the vertical axis.

As shown in the figure, with a shorter 95% attenuation time, that is, with a higher photo response property, generation of the exposure memory tends to be restrained. In particular, at the time the 95% attenuation time is 10 msec or less, the tendency is remarkable.

However, if the 95% attenuation time is too short, due to the excessive sensitivity with respect to the light beam, the surface potential may not be stable.

Therefore, the range of the value is preferably a value within a range of 1 to 10 msec, and it is more preferably a value within a range of 3 to 8 msec.

(6) Addition Amount

Moreover, it is preferable that the addition amount of the charge transporting agent used in the present invention is of a value within a range of 20 to 500 parts by weight with respect to 100 parts by weight of the binder resin comprising the charge generating layer.

The reason thereof is that with a value in such a range, the above-mentioned light absorption degree can be controlled in a predetermined range so that the excellent charge transporting ability and light absorption characteristics can be obtained with a good balance.

However, in the case the addition amount is too large, due to the high light absorption degree, although the photo memory can be improved, the dispersion property is lowered so that the charge transporting ability may be lowered. Moreover, on the contrary, in the case it is too small, the charge transporting ability may not be obtained sufficiently so as to cause the generation of the photo memory or the exposure memory.

Therefore, it is preferable that the range of the addition amount of such a charge transporting agent is of a value within a range of 20 to 90 parts by weight with respect to 100 parts by weight of the binder resin comprising the charge generating layer, and it is more preferably of a value within a range of 40 to 80 parts by weight.

(7) Binder Resin

Moreover, as the binder resin used for the charge transporting layer, a polycarbonate resin of a bisphenol A type, a bisphenol Z type, a bisphenol C type, or the like, a polyester resin, a methacrylic resin, an acrylic resin, a polyvinyl chloride resin, a polystyrene resin, a polyvinyl acetate resin, a styrene-butadiene copolymer resin, a chlorinated vinylidene-acrylonitrile copolymer resin, a chlorinated vinyl-vinyl acetate-maleic anhydride resin, a silicone resin, a silicone-alkyd resin, a phenol-formaldehyde resin, a styrene-alkyd resin, N-vinyl carbazole, or the like may be used. These may be used alone by one kind or as a combination of two or more kinds.

Among the binder resins, it is preferable to use a polycarbonate resin represented by the following general formulae (9) to (11) as the binder resin used for the charge transporting layer, and it is further preferable to use a polycarbonate resin represented by the following formulae (12) to (16).

(9)

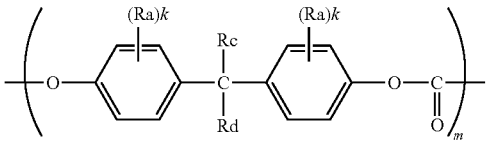

-continued

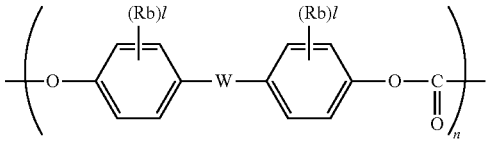

(In the general formula (9), Ra and Rb are each independently a hydrogen atom, an alkyl group having 1 to 4 carbon atoms, or a substituted or unsubstituted aryl group having 6 to 12 carbon atoms, k and 1 are each independently an integer from 0 to 4, Rc and Rd are a hydrogen atom or an alkyl group having 1 to 3 carbon atoms, and Rc and Rd are not same. Moreover, w id a single bond or —O—, —CO—, and m and n are a mole ratio satisfying the relational expression $0.05<n/(n+m)<0.6$.)

(10)

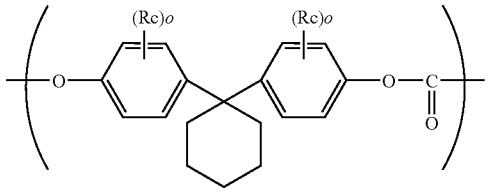

(In the general formula (10), a plurality of substitutents Rc are a hydrogen atom, a substituted or unsubstituted alkyl group having 1 to 4 carbon atoms, or a substituted or unsubstituted aryl group having 6 to 30 carbon atoms, and o is an integer from 0 to 4.)

(11)

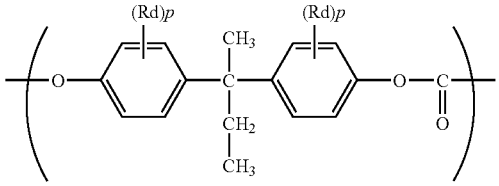

(In the general formula (11), a plurality of substitutents Rd are a hydrogen atom, a substituted or unsubstituted alkyl group having 1 to 4 carbon atoms, or a substituted or unsubstituted aryl group having 6 to 30 carbon atoms, and p is an integer from 0 to 4.)

(12)

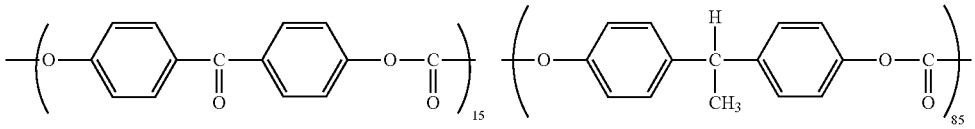

(Resin-1)

-continued (13)

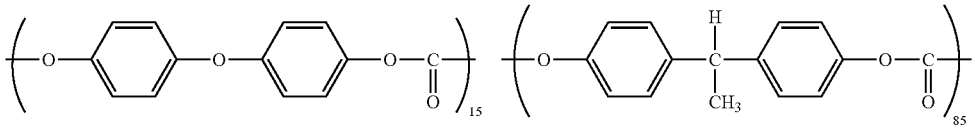

(Resin-2)

(14)

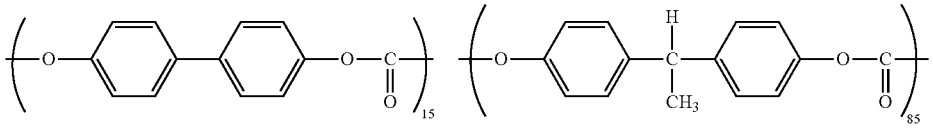

(Resin-3)

(15)

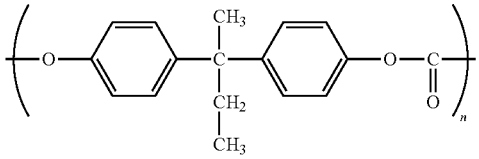

(Resin-4)

(16)

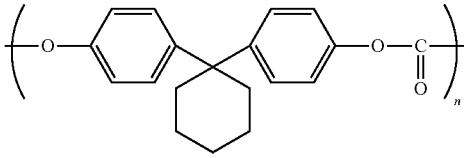

(Resin-5)

(8) Solvent

Moreover, as a solvent to be used at the time of forming the charge transporting layer, for example, aromatic hydrocarbons such as benzene, toluene, and chlorobenzene, ketones such as acetone and 2-butanone, halogenated aliphatic hydrocarbons such as methylene chloride, chloroform, and ethylene chloride, cyclic or straight chain ethers such as tetrahydrofuran, dioxane, ethylene glycol, and diethyl ether, or a solvent mixture thereof, or the like may be used.

(9) Film Thickness

Moreover, the film thickness of the charge transporting layer is not particularly limited as long as the above-mentioned light absorption degree can be exhibited. In general, it is preferably a value within a range of 0.01 to 40 μm, and it is more preferably a value within a range of 10 to 30 μm.

5. Intermediate Layer

It is preferable that the multilayer type electrophotographic photoconductor 10 shown in FIG. 1 is provided with an intermediate layer 14 on the base member 11 as its base layer. The reason thereof is that an electrophotographic photoconductor having a further better sensitivity characteristic can be provided by providing a predetermined light dispersing property and an electric conductivity to the intermediate layer. Moreover, by selecting the constituent material thereof, the physical adhesion property between the photoreceptor layer and the base member can also be improved.

Moreover, as the main constituent material for the intermediate layer, for example, in the case of controlling the light dispersing property, an additive such as a titanium oxide and a binder resin for dispersing the additive may be used.

(1) Additive

As to the kind of the additive to be added to the intermediate layer, in the case of aiming at preventing generation of the interference stripes by generating the light scattering or improving the dispersing property, or the like, organic fine powders or inorganic fine powders may be used.

More specifically, white pigments such as titanium oxide, zinc oxide, zinc flower, zinc sulfide, lead white, and litopon, inorganic pigments as an extender pigment such as alumina, calcium carbonate, and barium sulfide, fluorine resin particles, benzoguanamine resin particles, styrene resin particles, or the like may be used.

Moreover, it is preferable that its particle size is of a value within a range of 0.01 to 3 μm. The reason thereof is that if the particle size is too large, the ruggedness of the intermediate layer may be large, an electrically uneven portion may be generated, and furthermore, the image defect may easily be generated. On the other hand, in the case the particle size is too small, a sufficient light scattering effect may not be obtained.

Its addition amount is preferably of a value of 10% by weight or less with respect to the solid component of the intermediate layer by the weight ratio, within a range of 0.01 to 5% by weight, and it is further preferably of a value within a range of 0.01 to 1% by weight.

(2) Binder Resin

As the binder resin used for the intermediate layer, for example, at least one resin selected from the group consisting of a polyamide resin, a polyvinyl alcohol resin, a polyvinyl butylal resin, a polyvinyl formal resin, a vinyl acetate resin, a phenoxy resin, a polyester resin, and an acrylic resin may be used.

(3) Film Thickness

The film thickness of the intermediate layer is not particularly limited as long as it can smooth the ruggedness of the base member surface as the base by covering the same. For example, it is preferably of a value within a range of 0.1 to 50 μm.

However, if the film thickness is too thick, although the surface can be smoothed, due to the decline of the electric conductivity with respect to the base member, the charge can easily be accumulated in the photoreceptor layer. Moreover, on the contrary, in the case the film thickness is too thin, a sufficiently flat surface may not be obtained.

Therefore, the range of the film thickness is preferably of a value within a range of 1 to 30 μm, and it is more preferably a value within a range of 3 to 20 μm.

6. Others

Moreover, according to the multilayer type electrophotographic photoconductor of the present invention, for the purpose of preventing deterioration of the photoconductor by the ozone, the oxidizing gas generated in the electrophotographic apparatus, or light and heat, it is preferable to add an antioxidant, a photo stabilizing agent, a heat stabilizing agent, or the like into the photoconductor layer.

For example, as the antioxidant, hindered phenol, hindered amine, paraphenylene diamine, aryl alkane, hydroquinone, spirochromane, spiroindanone, these derivatives thereof, an organic sulfur compound, an organic phosphorus compound, or the like may be used. Moreover, as the photo stabilizing agent, a derivative of a benzophenone, benzotriazole, dithiocarbamate, tetramethyl piperidine, or the like may be used.

7. Production Method (1) Production Method for the Intermediate Layer

As to the production method for the intermediate layer, first a coating solution is produced by dissolving an additive and a binder resin in a solvent and applying a predetermined dispersing process. Then, production can be carried out by applying the coating solution onto a conductive base member of aluminum, or the like by a predetermined coating method.

At the time, as to the method for the dispersing process, a roll mill, a ball mill, a vibration ball mill, an attriter, a sand mill, a colloid mill, a paint shaker, or the like may be used.

Moreover, as to the coating method, a soaking coating method (dipping coating method), a spray coating method, a bead coating method, a blade coating method, a roller coating method, or the like may be used.

Moreover, for stably forming the intermediate layer, it is preferable to carry out the heating and drying process at 30 to 200° C. for 5 minutes to 2 hours after coating.

(2) Production Method for the Charge Generating Layer

As to the production method for the charge generating layer, first a coating solution is produced by dissolving a charge generating agent and a binder resin in a solvent and applying a predetermined dispersing process. Then, production can be carried out by applying the coating solution onto a conductive base member of aluminum, or the like or an intermediate layer formed on its surface by a predetermined coating method. Moreover, the coating solution may optionally contain a charge transporting agent such as a hole transporting agent and an electron transporting agent for controlling its electric characteristic.

The dispersing process method and the coating method at the time may be same as those of the intermediate layer.

Moreover, for stably forming the charge generating layer, it is preferable to dry at 60° C. to 150° C. drying temperature using a high temperature drying machine, a reduced pressure drying machine, or the like.

(3) Production Method for the Charge Transporting Layer

As to the production method for the charge transporting layer, first a coating solution is produced by dissolving a charge transporting agent and a binder resin in a solvent and applying a predetermined dispersing process. Then, production can be carried out by applying the coating solution onto a base member with a charge generating layer formed.

The dispersing process method and the coating method at the time may be same as those of the intermediate layer and the charge generating layer.

[Second Embodiment]

A second embodiment is an image forming apparatus comprising a multilayer type electrophotographic photoconductor having a charge generating layer containing at least a charge generating agent on a base member directly or via an intermediate layer, and a charge transporting layer containing at least a charge transporting agent and a binder resin formed successively, wherein a charging means, an exposure means, a developing means and a transfer means are provided around the multilayer type electrophotographic photoconductor, the light absorption degree at a 680 nm wavelength light beam in the photoconductive layer of the multilayer type electrophotographic photoconductor is of a value of 0.8 or less, and the light absorption degree at a 450 nm wavelength light beam is of a value of 1.0 or more.

Hereafter, the second embodiment will be explained mainly on the points different from those of the first embodiment while omitting the content already described in the first embodiment.

1. Image Forming Apparatus

Figure 12:
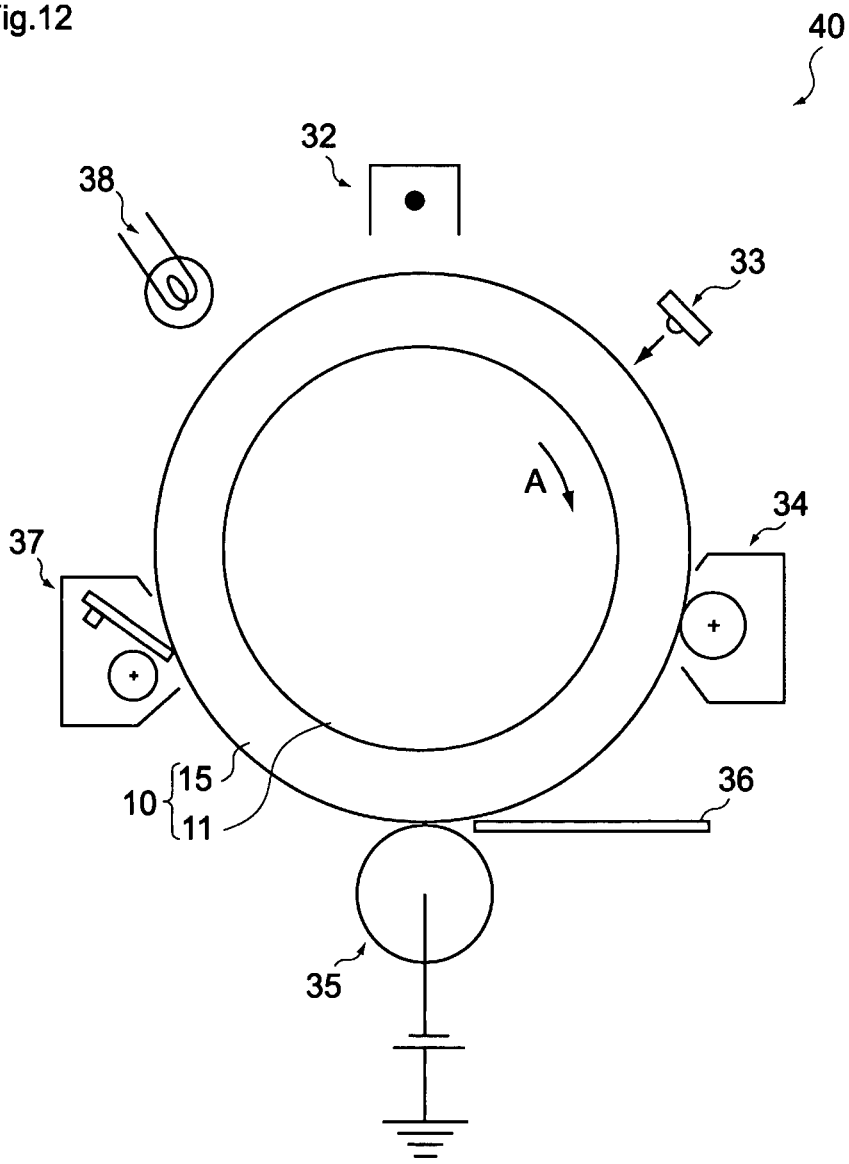
FIG. 12 is a schematic diagram showing an image forming apparatus according to the present invention.

As shown in FIG. 12, the image forming apparatus used in the present invention is an image forming apparatus 40 comprising a charging means 32 for charging the photoconductor surface to a predetermined potential, an exposing means 33 for forming a latent image on the charged photoconductor surface, a developing means 34 for developing for visualizing the latent image with a developing agent, a transferring means 35 for transferring the visualized image onto a printing paper 36, and a cleaning means 37 for removing the developing agent remaining on the photoconductor surface after the transfer successively provided around the multilayer type electrophotographic photoconductor 10.

In such an image forming apparatus, it is preferable that the rotational rate of the multilayer type electrophotographic photoconductor is of a value within a range of 10 to 200 mm/sec.

The reason thereof is that a continuous printing operation can be enabled while maintaining a predetermined printing efficiency by the image formation by such a rotational rate. Moreover, if the rotational rate is too high, the sensitivity of the electrophotographic photoconductor may not follow the processing speed, however, since the multilayer type electrophotographic photoconductor has the excellent sensitivity with little generation of the image memory, the continuous printing operation can be enabled without generation of such a problem.

Moreover, as a modification of the cleaning means 37, it is also preferable to adopt a developing simultaneous cleaning system of carrying out the cleaning operation in the developing means 34. The reason thereof is that the miniaturization of the apparatus can be enabled by eliminating the cleaning means 37 by using such a system.

2. Image Forming Method

Next, the image forming method using the image forming apparatus 40 will be explained.

As to the procedure of operating the image forming apparatus 40 shown in FIG. 12, first the electrophotographic photoconductor 10 is rotated in the direction shown by the arrow A by a predetermined processing speed (peripheral speed), and then its surface is charged to a predetermined potential by the charging means 32.

Then, the surface of the electrophotographic photoconductor 10 is exposed via a reflection mirror, or the like while having the photo modulation according to the image information by the exposing means 33. According to the exposure, a static latent image is formed on the surface of the electrophotographic photoconductor 10.

Then, based on the electrostatic latent image, the latent image development is carried out by the developing means 34. By attaching a toner stored inside the developing means 34 according to the electrostatic latent image on the surface of the electrophotographic photoconductor 10, a toner image can be formed.

Moreover, the printing paper 36 is conveyed to below the photoconductor along the predetermined transfer conveyance path. At the time, by applying a predetermined transfer bias between the electrophotographic photoconductor 10 and the transfer means 35, the toner image can be transferred onto the printing paper 36.

Then, the printing paper 36 after the transfer of the toner image is separated form the electrophotographic photoconductor 10 surface by a separating means (not shown) so as to be conveyed to a fixing device by the conveyance belt. Then, after fixing the toner image onto the surface by the heating and pressuring process by the fixing device, it is discharged to the outside of the image forming apparatus 40 by a discharge roller.

On the other hand, the electrophotographic photoconductor 10 after the transfer of the toner image continues the rotation as it is such that the residual toner (adhered substance) without transfer onto the printing paper 36 at the time of the transfer is removed from the surface of the electrophotographic photoconductor 10 by the cleaning device 37. Thereafter, it is completely erased by the electricity removing beam irradiation from an electricity removing device 38 so as to be provided for the next image formation.

Therefore, since the multilayer type electrophotographic photoconductor 10 of the present invention is used for the image forming apparatus 10, the light absorption degree of a predetermined wavelength in the photoconductive layer can be limited so that an image forming apparatus with the generation of the exposure memory and the photo memory restrained can be provided.

EXAMPLES

Example 1

1. Production of the Multilayer Type Electrophotographic Photoconductor (1) Production of the Intermediate Layer An intermediate layer (lower layer) coating solution was prepared by placing in a container 2 parts by weight of a titanium oxide (produced by TEIKA Corp., SMT-02, numeral average primary particle size: 10 nm) with the surface treatment with methyl hydrogen polysiloxane while wet dispersion after the surface treatment with alumina and silica, 1 part by weight of a four element copolymerized polyamide resin (produced by Toray Corp., AMIRAN CM8000), 10 parts by weight of methanol, and 2 parts by weight of butanol, and dispersing for 5 hours using a bead mill (medium: a 0.5 mm diameter zirconia ball).

Then, after filtrating the obtained intermediate layer coating solution with a 5 μm filter, it was coated onto an aluminum base member having a 30 mm diameter and a 238.5 mm length by using a dip coating method with a 5 mm/sec drawing rate.

Finally, by applying a heat treatment at 130° C. for 30 minutes as the hardening process, a 2 μm film thickness intermediate layer was obtained.

(2) Production of the Charge Generating Layer (2)-1 Production of the Charge Generating Agent A titanyl phthalocyanine (CGM-1) to be used as the charge generating agent was synthesized as follows.

First, as a pigment pre-process, 25 g of o-phthalonitrile, 28 g of titanium tetrabutoxide, 3.1 g of urea and 300 g of quinoline were added to an argon-substituted flask so as to have the temperature rise to 150° C. while agitating.

Then, after raising the temperature to 215° C. while removing the vapor generated form the reaction vessel to the outside, reaction was further carried out for 2 hours while maintaining the temperature.

After finishing the reaction, the reaction mixture was taken out from the flask at the time of being cooled down to 150° C. so as to be filtrated with a glass filter. The obtained solid was washed successively with N,N-dimethyl formamide and methanol and vacuum-dried so as to obtain 24 g of a titanyl phthalocyanine compound (blue purple solid).

10 g of the titanyl phthalocyanine compound (blue purple solid) obtained by the pigment pre-process was added to 100 milliliters of N,N-dimethyl formamide so as to have a heat treatment at 130° C. for 2 hours while agitating as the pigment process. Thereafter, at the time of passage of 2 hours, the heating operation was stopped for cooling down to 23±1° C. and the agitating operation was stopped so as to be left still in this state for 1 hour for stabilization.

Finally, by filtrating the solution with a glass filter, washing the obtained solid with methanol and vacuum drying, 9.83 g of coarse crystals of a titanyl phthalocyanine compound was obtained.

5 g of the coarse crystals obtained by the pigment process were dissolved in 100 milliliters of a concentrated sulfuric acid so as to be dropped into water chilled with ice, and then it was agitated for 15 minutes in the room temperature so as to be left still for 6 minutes at around 23±1° C. for re-crystallization.

Then, the solution was filtrated with a glass filter, the obtained solid washed with water until the washing solution becomes neutral, and then it was dispersed in 200 ml of chlorobenzene in a state with the presence of water without drying so as to be heated to 50° C. and agitated for 10 hours.

Thereafter, after filtrating the solution with a glass filter, the obtained solid was vacuum dried at 50° C. for 5 hours so as to obtain 4.1 g of titanyl phthalocyanine crystals (blue powders) were obtained.

According to the titanyl phthalocyanine crystals accordingly obtained, at the initial stage, and even after soaking in 1,3-dioxoran or tetrahydrofuran for 7 days, no peak generation was confirmed in the Bragg angle of 2θ±0.2°=7.4° and 26.2°, and furthermore, one peak was observed at 296° other than the peak in the vicinity of 90° accompanied by the vaporization of the adsorbed water.

Moreover, measurement of the X ray diffraction as the crystal characteristic evaluation was carried out using a X-ray diffraction device RINT 1100 (produced by RIGAKU DENKI Corp.) under the conditions of the X ray tube: Cu (Kα line), the tube voltage: 40 kV, the tube current: 30 mA, the start angle: 3.0°, the stop angle: 40.0°, and the scanning speed: 10°/minute.

Moreover, the differential scanning calorie analysis as the heat characteristic evaluation was carried out using a differential scanning calorimeter such as TAS-200 type, DSC8230D (produced by RIGAKU DENKI Corp.) under the conditions of the sample pan: aluminum, the temperature raising rate: 20° C./minute.

(2)-2 Production of the Charge Generating Layer Coating Solution

A charge generating layer coating solution was obtained by mixing 2 parts by weight of the titanyl phthalocyanine obtained by the above-mentioned method, 1 part by weight of a polyvinyl butylal resin (produced by DENKI KAGAKU KOGYO Corp., DENKA butylal #6000EP) as the binder resin, 40 parts by weight of propylene glycol monomethyl ether as the dispersion medium, and 40 parts by weight of tetrahydrofuran, and dispersing the same for 2 hours with a bead mill.

Then, after filtrating the obtained charge generating layer coating solution with a 3 μm filter, it was coated onto an aluminum base member with an intermediate layer formed on the surface by a dip coating method.

Finally, by drying at 100° C. for 5 minutes as the hardening process, a 0.3 μm film thickness charge generating layer was formed.

(3) Production of the Charge Transporting Layer

A charge transporting layer coating solution was obtained by mixing and dissolving 70 parts by weight of a bisstilbene compound (HTM-1) as the hole transporting agent, 10 parts by weight of methaterphenyl as the additive, 33 parts by weight of a polycarbonate resin (Resin-1, viscosity average molecular weight 30,500) as the binder resin A, 67 parts by weight of a polycarbonate resin (Resin-4, viscosity average molecular weight 20,000) as the binder resin B, and 600 parts by weight of tetrahydrofuran as the solvent.

Then, in the same manner as the charge generating layer coating solution, the obtained charge transporting layer coating solution was applied onto the charge generating layer and dried at 110° C. for 50 minutes so as to form a 20 μm film thickness charge transporting layer for obtaining a multilayer type electrophotographic photoconductor shown in the table 1.

2. Evaluation (1) Light Absorption Degree Measurement and Evaluation

The light absorption degree at a 680 nm wavelength light beam in the photoconductive layer was measured using a color difference meter (produced by Minolta Corp., color difference meter CM1000). Moreover, the measurement results were evaluated according to the following criteria. The obtained results are shown in the table 2.

The light absorption degree of the photoconductive layer denotes the value obtained by subtracting the value of the light absorption degree of the element tube alone from the value of the light absorption degree in the photoconductive layer formed on the element tube.

Good: a value of 0.8 or less of the light absorption degree at a 680 nm wavelength light beam.

Bad: a value of more than 0.8 of the light absorption degree at a 680 nm wavelength light beam Moreover, using the same measurement instrument, the light absorption degree at a 450 nm wavelength light beam was measured. Moreover, the measurement results were evaluated according to the following criteria. The obtained results are shown in the table 1 and the table 2.

Good: a value of 1.0 or more of the light absorption degree at a 450 nm wavelength light beam.

Bad: a value of less than 1.0 of the light absorption degree at a 450 nm wavelength light beam (2) Bright Potential Measurement and Evaluation Using a drum sensitivity testing machine (produced by GENTEC Corp.), after charging the electrophotographic photoconductor surface to −700 V under the ordinary temperature and the ordinary humidity (temperature: 20° C., humidity: 60%), while exposing the electrophotographic photoconductor surface for 1.5 seconds with a 8 $\mu W/cm^2$ light beam processed to be monochrome with a 780 nm wavelength and a 20 nm half value width using a band pass filter from a white beam of a halogen lamp, the surface potential after 0.5 second from the start of the exposure was measured as the bright potential. Moreover, the measurement results were evaluated according to the following criteria. The obtained results are shown in the table 2.

Since the electrophotographic photoconductor is of a negative charge type, the value of the bright potential is a negative value as well. In the table 2, the absolute value thereof is indicated in the table 2.

Good: The bright potential is of a value of 40 V or less.

Bad: The bright potential is of a value more than 40 V.

(3) Photo Response Property Measurement and Evaluation

At the time of charging the photoconductor to a −700 V charge voltage with a drum sensitivity testing machine (produced by GENTEC Corp.) under the ordinary temperature and the ordinary humidity (temperature: 20° C., humidity: 60%), a light beam (pulse width: 50 nm, wavelength: 780 nm) of a xenon flash lamp was directed to the photoconductor for temporarily setting the light amount such that the surface potential after 300 msec from the start of the irradiation is −100 V. Then, the time needed for having the surface potential of −130 V (95% response property) in the case of irradiating the photoconductor with the light amount of such setting conditions was calculated as the photo response property.

Moreover, the calculation results were evaluated according to the following criteria. The obtained results are shown in the table 2.

Good: The 95% attenuation time is of a value of 10 msec or less.

Bad: The 95% attenuation time is of a value of more than 10 msec.

(4) Exposure Memory Measurement and Evaluation

With the obtained multilayer type electrophotographic photoconductor loaded on a printer adopting a negative charge reversal development process (MicroLine-22N produced by Oki Data Corp.), an image for the exposure memory evaluation was output. Then, using a surface potential meter, the potential difference between the blank paper potential in the next cycle at a portion with the exposure corresponding to a solid image on the photoconductor surface and the surface potential of the unexposed portion was evaluated as the memory potential (V) according to the following criteria. The obtained results are shown in the table 2.

Good: The exposure memory potential is of a value of 20 V or less.

Bad: The exposure memory potential is of a value of more than 20 V.

(5) Light Resistance Property (Photo Memory) Evaluation

An electrophotographic photoconductor with a partial light shield was left in a room of a light degree 500 (lux) for one hour.

Thereafter, with the electrophotographic photoconductor loaded on a printer adopting a negative charge reversal development process (MicroLine-22N produced by Oki Data Corp.), a gray image was output for the visual inspection of the concentration difference between the irradiated portion and the light shielded portion. Moreover, the same visual evaluation was executed after passage of 24 hours from the irradiation. Moreover, the inspection results were evaluated according to the following criteria. The obtained results are shown in the table 2.

Good: The image concentration difference was not found between the irradiated portion and the light shielded portion.

Bad: The image concentration difference was found between the irradiated portion and the light shielded portion.

TABLE 1

| | Charge generating layer | | | Charge transporting layer | | | | | |
|---|---|---|---|---|---|---|---|---|---|
| | Charge generating agent | | | Positive hole transporting agent | | | Binder resin | | |
| | Compound | Content (% by weight) | Film thickness (μm) | Compound | I.P (eV) | Content (% by weight) | Binder resinA | Binder resinB | Mixing ratio (A:B) |
| Example 1 | CGM-1 | 67 | 0.3 | HTM-1 | 5.45 | 39 | Resin-1 | Resin-4 | 1:2 |
| Example 2 | CGM-1 | 67 | 0.3 | HTM-2 | 5.41 | 39 | Resin-1 | Resin-4 | 1:2 |
| Example 3 | CGM-1 | 67 | 0.3 | HTM-3 | 5.42 | 39 | Resin-1 | Resin-4 | 1:2 |
| Example 4 | CGM-1 | 67 | 0.3 | HTM-4 | 5.39 | 39 | Resin-1 | Resin-4 | 1:2 |
| Example 5 | CGM-1 | 67 | 0.3 | HTM-5 | 5.41 | 39 | Resin-1 | Resin-4 | 1:2 |
| Example 6 | CGM-1 | 67 | 0.25 | HTM-1 | 5.45 | 39 | Resin-1 | Resin-4 | 1:2 |
| Example 7 | CGM-1 | 67 | 0.3 | HTM-1 | 5.45 | 39 | Resin-1 | Resin-5 | 1:2 |
| Example 8 | CGM-1 | 67 | 0.3 | HTM-1 | 5.45 | 39 | Resin-2 | Resin-4 | 1:2 |
| Example 9 | CGM-1 | 67 | 0.3 | HTM-1 | 5.45 | 39 | Resin-3 | Resin-5 | 1:2 |
| Comparative example 1 | CGM-1 | 67 | 0.3 | HTM-6 | 5.40 | 39 | Resin-1 | Resin-4 | 1:2 |
| Comparative example 2 | CGM-1 | 67 | 0.3 | HTM-7 | 4.92 | 39 | Resin-1 | Resin-4 | 1:2 |
| Comparative example 3 | CGM-1 | 67 | 0.3 | HTM-8 | 5.50 | 39 | Resin-1 | Resin-4 | 1:2 |
| Comparative example 4 | CGM-1 | 67 | 0.3 | HTM-9 | 5.35 | 39 | Resin-1 | Resin-4 | 1:2 |
| Comparative example 5 | CGM-1 | 67 | 0.3 | HTM-10 | 5.21 | 39 | Resin-1 | Resin-4 | 1:2 |
| Comparative example 6 | CGM-1 | 67 | 0.38 | HTM-1 | 5.45 | 39 | Resin-1 | Resin-4 | 1:2 |
| Comparative example 7 | CGM-1 | 67 | 0.43 | HTM-1 | 5.45 | 39 | Resin-1 | Resin-4 | 1:2 |
| Comparative example 8 | CGM-1 | 67 | 0.47 | HTM-1 | 5.45 | 39 | Resin-1 | Resin-4 | 1:2 |
| Comparative example 9 | CGM-1 | 67 | 0.25 | HTM-6 | 5.40 | 39 | Resin-1 | Resin-4 | 1:2 |
| Comparative example 10 | CGM-1 | 67 | 0.38 | HTM-6 | 5.40 | 39 | Resin-1 | Resin-4 | 1:2 |
| Comparative example 11 | CGM-1 | 67 | 0.43 | HTM-6 | 5.40 | 39 | Resin-1 | Resin-4 | 1:2 |
| Comparative example 12 | CGM-1 | 67 | 0.47 | HTM-6 | 5.40 | 39 | Resin-1 | Resin-4 | 1:2 |

TABLE 2

| | Light absorption degree | | | | Photo response property | | Exposure memory | | Bright potential | | Light resistance property (photo memory) | |
|---|---|---|---|---|---|---|---|---|---|---|---|---|
| | Wavelength 680 nm | | Wavelength 450 nm | | Response time | Evalu- | Potential difference | Evalu- | Potential difference | Evalu- | After | After 24 |
| | Result | Evaluation | Result | Evaluation | (msec) | ation | (V) | ation | (V) | ation | 1 hour | hours |
| Example1 | 0.65 | Good | 1.21 | Good | 9.4 | Good | 15 | Good | 35 | Good | Good | Good |
| Example2 | 0.65 | Good | 1.25 | Good | 5.2 | Good | 17 | Good | 31 | Good | Good | Good |
| Example3 | 0.65 | Good | 1.20 | Good | 4.8 | Good | 14 | Good | 25 | Good | Good | Good |
| Example4 | 0.64 | Good | 1.21 | Good | 5.2 | Good | 19 | Good | 34 | Good | Good | Good |
| Example5 | 0.65 | Good | 1.29 | Good | 6.2 | Good | 15 | Good | 29 | Good | Good | Good |
| Example6 | 0.55 | Good | 1.21 | Good | 8.5 | Good | 10 | Good | 38 | Good | Good | Good |
| Example7 | 0.65 | Good | 1.21 | Good | 9.4 | Good | 15 | Good | 35 | Good | Good | Good |
| Example8 | 0.65 | Good | 1.15 | Good | 9.5 | Good | 15 | Good | 32 | Good | Good | Good |
| Example9 | 0.63 | Good | 1.28 | Good | 9.7 | Good | 18 | Good | 36 | Good | Good | Good |
| Comparative example 1 | 0.64 | Good | 0.51 | Bad | 25 | Bad | 14 | Good | 61 | Bad | Bad | Good |
| Comparative example 2 | 0.64 | Good | 0.96 | Bad | 49 | Bad | 25 | Bad | 38 | Good | Good | Good |
| Comparative example 3 | 0.65 | Good | 0.03 | Bad | 65 | Bad | 9 | Good | 85 | Bad | Bad | Bad |
| Comparative example 4 | 0.63 | Good | 0.10 | Bad | 42 | Bad | 20 | Good | 80 | Bad | Bad | Bad |
| Comparative example 5 | 0.65 | Good | 0.12 | Bad | 68 | Bad | 21 | Bad | 72 | Bad | Bad | Bad |
| Comparative example 6 | 0.82 | Bad | 1.25 | Good | 8.8 | Good | 20 | Good | 33 | Good | Good | Good |

TABLE 2-continued

| | Light absorption degree | | | | Photo response property | | Exposure memory | | Bright potential | | Light resistance property (photo memory) | |
|---|---|---|---|---|---|---|---|---|---|---|---|---|
| | Wavelength 680 nm | | Wavelength 450 nm | | Response time | Evalu- | Potential difference | Evalu- | Potential difference | Evalu- | After | After 24 |
| | Result | Evaluation | Result | Evaluation | (msec) | ation | (V) | ation | (V) | ation | 1 hour | hours |
| Comparative example 7 | 0.94 | Bad | 1.20 | Good | 7.2 | Good | 25 | Bad | 35 | Good | Good | Good |
| Comparative example 8 | 1.02 | Bad | 1.22 | Good | 8.2 | Good | 35 | Bad | 41 | Bad | Bad | Good |
| Comparative example 9 | 0.54 | Good | 0.45 | Bad | 25 | Bad | 8 | Good | 74 | Bad | Bad | Good |
| Comparative example 10 | 0.83 | Bad | 0.56 | Bad | 29 | Bad | 16 | Good | 54 | Bad | Bad | Good |
| Comparative example 11 | 0.94 | Bad | 0.56 | Bad | 24 | Bad | 24 | Bad | 39 | Good | Bad | Bad |
| Comparative example 12 | 1.02 | Bad | 0.52 | Bad | 31 | Bad | 34 | Bad | 38 | Good | Bad | Bad |

Examples 2 to 6

In the examples 2 to 6, an electrophotographic photoconductor was produced and evaluated in the same manner as in the example 1 except that the kind of the hole transporting agent and the film thickness of the charge generating layer were changed as shown in the table 1 at the time of producing a multilayer type electrophotographic photoconductor. The obtained results are shown in the table 2. Moreover, the structure formulae of the hole transporting agents (HTM-3 to 5) are used in the examples 3 to 5 are as follows.

(17)

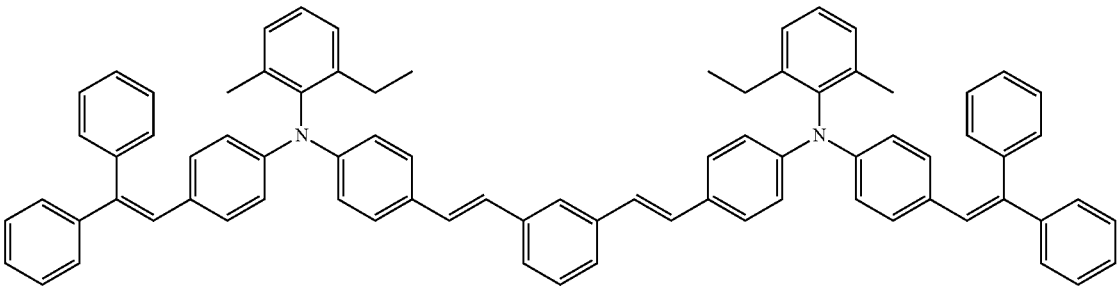

(HTM-3)

(18)

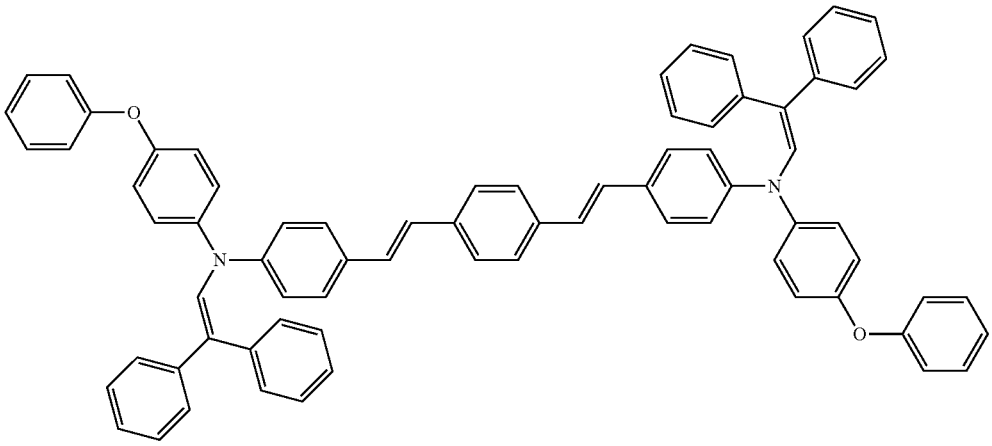

(HTM-4)

-continued (19)

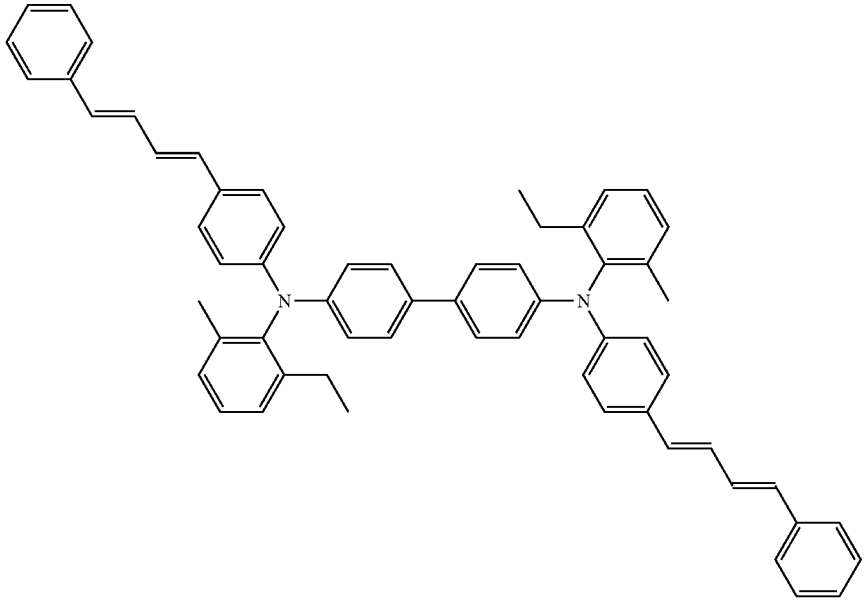

(HTM-5)

Examples 7 to 9

In the examples 7 to 9, an electrophotographic photoconductor was produced and evaluated in the same manner as in the example 1 except that the kind of the binder resin was changed as shown in the table 1 at the time of producing a multilayer type electrophotographic photoconductor. The obtained results are shown in the table 2.

Comparative Examples 1 to 5

In the comparative examples 1 to 5, an electrophotographic photoconductor was produced and evaluated in the same manner as in the example 1 except that the kind of the hole transporting agent was changed as shown in the table 1 at the time of producing a multilayer type electrophotographic photoconductor. The obtained results are shown in the table 2. Moreover, the structure formulae of the hole transporting agents (HTM-6 to 10) used in the comparative examples 1 to 5 are as follows.

(20)

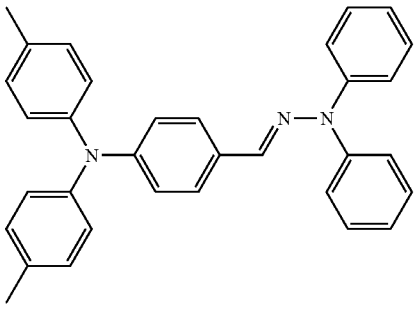

(HTM-6)

-continued (21)

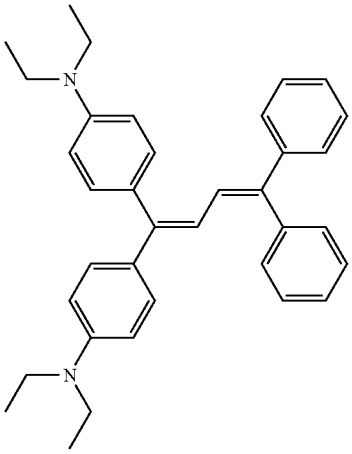

(HTM-7)

(22)

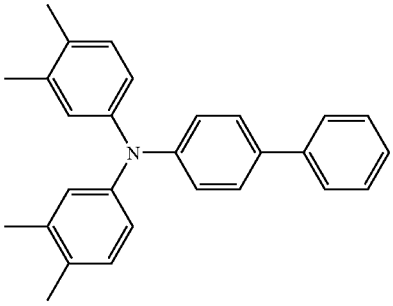

(HTM-8)

-continued (23)

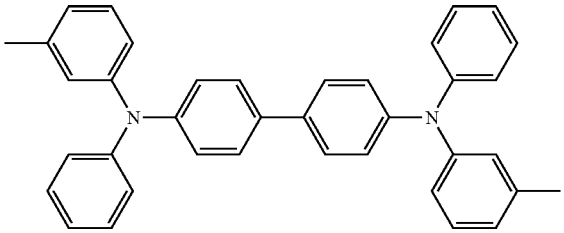

(HTM-9)

(24)

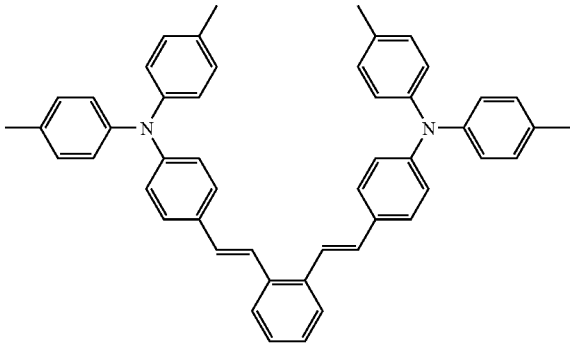

(HTM-10)

Comparative Examples 6 to 12

In the comparative examples 6 to 12, an electrophotographic photoconductor was produced and evaluated in the same manner as in the example 1 except that the kind of the hole transporting agent and the film thickness of the charge generating layer were changed as shown in the table 1 at the time of producing a multilayer type electrophotographic photoconductor. The obtained results are shown in the table 2.

According to a multilayer type electrophotographic photoconductor and an image forming apparatus comprising a multilayer type electrophotographic photoconductor of the present invention, since the light absorption degree at a 680 nm wavelength light beam in the photoconductive layer is of a value of 0.8 or less, and the light absorption degree at a 450 nm wavelength light beam is of a value of 1.0 or more, even in the case of carrying out the image formation continuously, the excellent electric characteristics and image characteristics can be obtained stably by restraining generation of the exposure memory and the photo memory.

Therefore, the multilayer type electrophotographic photoconductor and an image forming apparatus comprising the multilayer type electrophotographic photoconductor of the present invention are expected to contribute to achievement of a high image quality, a high speed, or the like in various kinds of image forming apparatus such as a copying machine and a printer.

What is claimed is:

1. A multilayer type electrophotographic photoconductor comprising a charge generating layer containing at least a charge generating agent on a base member directly or via an intermediate layer, and a charge transporting layer containing at least a charge transporting agent and a binder resin formed successively, wherein the base member is aluminum;

the film thickness of the charge generating layer is a value within a range from 0.2 or more to below 0.38 μm, the charge generating agent comprises a titanyl phthalocyanine crystal having a peak in a Bragg angle of 2θ±0.2°=27.2° in a CuKα characteristic X-ray diffraction spectrum and having one peak within a range of 270 to 400° C. other than a peak accompanied by the vaporization of adsorbed water in a differential scanning calorie analysis;

the charge transporting agent comprises a hole transporting agent represented by one of the following general formulae (3), and (5) to (6); and wherein the light absorption degree at a 680 nm wavelength light beam in a photoconductive layer of the multilayer type electrophotographic photoconductor is of a value of 0.8 or less, and the light absorption degree at a 450 nm wavelength light beam is of a value of 1.0 or more;

(3)

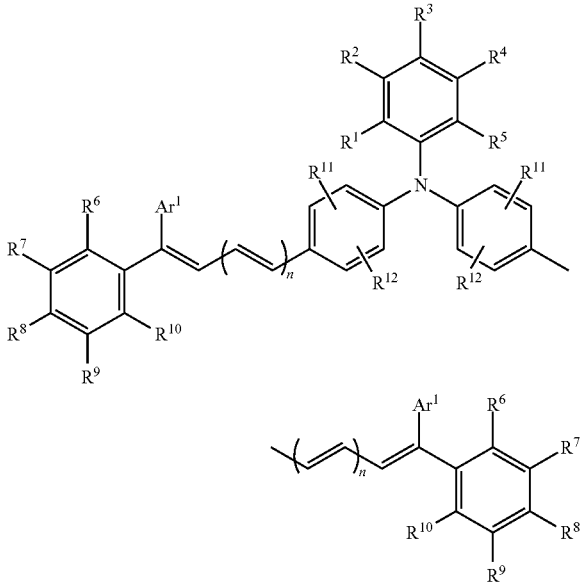

wherein in the general formula (3), $R^1$ to $R^{12}$ are each independently a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, or —$OR^{13}$, wherein $R^{13}$ is an alkyl group having 1 to 10carbon atoms, a perfluoroalkyl group, or an aryl group having 6 to 30 carbon atoms, $Ar^1$ is a hydrogen atom, a substituted or unsubstituted alkyl group having 1 to 12 carbon atoms, or a substituted or unsubstituted aryl group having 6 to 30 carbon atoms, and n is an integer of 0 to 2;

(5)

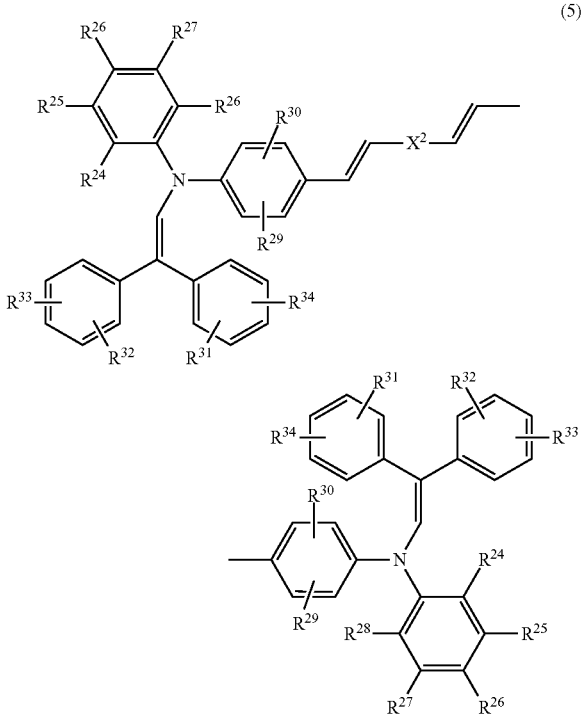

wherein in the general formula (5), $X^2$ is a substituted or unsubstituted arylene group having 6 to 30 carbon atoms, an unsubstituted hydrocarbon group having an aryl group having 6 to 30 carbon atoms, or a condensed polycyclic hydrogen group having 10 to 30 carbon atoms, $R^{24}$ to $R^{34}$ are each independently a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, or —$OR^{35}$, wherein $R^{35}$ is an alkyl group having 1 to 10 carbon atoms, a perfluoroalkyl group, or an aryl group having 6 to 30 carbon atoms, $R^{24}$ to $R^{28}$, $R^{29}$ and $R^{30}$, $R^{31}$ and $R^{34}$, and $R^{32}$ and $R^{33}$ may form a saturated or unsaturated ring by linking two substituents with each other, or $R^{26}$ may be a substituent of the following formula (5') in addition to the above mentioned substituents;

(5')

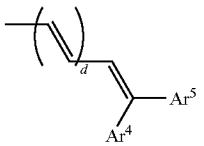

in the general formula (5'), $Ar^4$ and $Ar^5$ are a hydrogen atom, a substituted or unsubstituted alkyl group having 1 to 12 carbon atoms, or a substituted or unsubstituted aryl group having 6 to 30 carbon atoms, and d is an integer of 0 to 2;

(6)

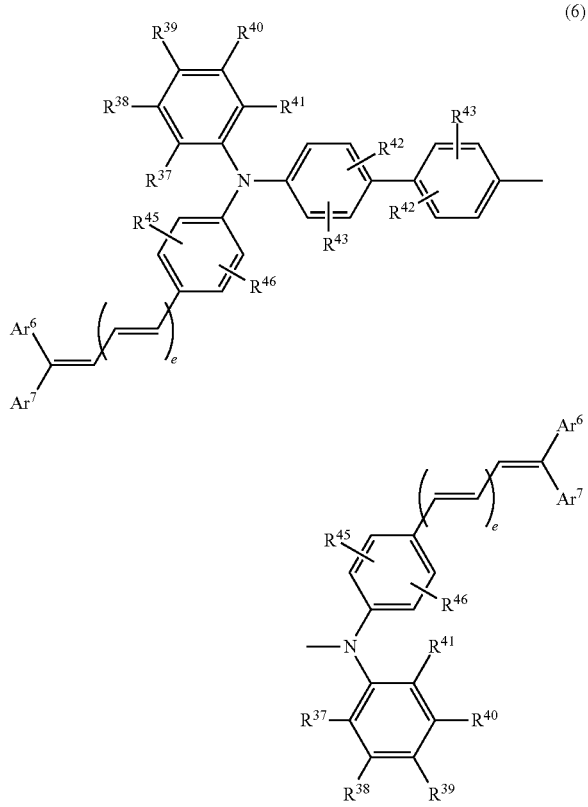

in the general formula (6), $R^{37}$ to $R^{46}$ are each independently a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, or —$OR^{47}$, wherein $R^{47}$ is an alkyl group having 1 to 10 carbon atoms, a perfluoroalkyl group, or an aryl group having 6 to 30 carbon atoms, $R^{37}$ to $R^{41}$, $R^{42}$ and $R^{43}$ and $R^{45}$ and $R^{46}$ may form a saturated or unsaturated ring by linking two substituents with each other, $Ar^6$ and $Ar^7$ are a hydrogen atom, a substituted or unsubstituted alkyl group having 1 to 12 carbon atoms, or a substituted or unsubstituted aryl group having 6 to 30 carbon atoms and e is an integer of 0 to 2.

2. The multilayer type electrophotographic photoconductor according to claim 1, wherein the light absorption degree at a 680 nm wavelength light beam in the charge generating layer is of a value of 0.8 or less.

3. The multilayer type electrophotographic photoconductor according to claim 1, wherein the content of the charge generating agent in the charge generating layer is of a value within a range of 30 to 80% by weight with respect to the total amount in the charge generating layer.

4. The multilayer type electrophotographic photoconductor according to claim 1, wherein the light absorption degree at a 450 nm wavelength light beam in the charge transporting layer is of a value of 1.0 or more.

5. The multilayer type electrophotographic photoconductor according to claim 1, wherein the time necessary for attenuating the charge potential to 95% of the potential range ($V_1$-$V_2$) is 10 msec or less, with the premise that the initial charge potential of the multilayer type electrophotographic photoconductor is $V_1$ (V) and the charge potential after passage of 300 msec after the exposure is $V_2$(V).

6. The multilayer type electrophotographic photoconductor according to claim 1, wherein the ionizing potential of the charge transporting agent is a value within a range of 5.3 to 6.0 eV.

7. An image forming apparatus comprising a multilayer type electrophotographic photoconductor having a charge generating layer containing at least a charge generating agent on a base member directly or via an intermediate layer, and a charge transporting layer containing at least a charge transporting agent and a binder resin formed successively, wherein the base member is aluminum;

the film thickness of the charge generating layer is a value within a range from 0.2 or more to below 038 μm, the charge generating agent comprises a titanyl phthalocyanine crystal having a peak in a Bragg angle of 2θ±0.2°=27.2° in a CuKα characteristic X-ray diffraction spectrum and having one peak within a range of 270 to 400° C. other than a peak accompanied by the vaporization of adsorbed water in a differential scanning calorie analysis;

the charge transporting agent comprises a hole transporting agent represented by one of the following general formulae (3), and (5) to (6); and wherein a charging means, an exposure means, a developing means and a transfer means are provided around the multilayer type electrophotographic photoconductor, the light absorption degree at a 680 nm wavelength light beam in a photoconductive layer of the multilayer type electrophotographic photoconductor is of a value of 0.8 or less, and the light absorption degree at a 450 nm wavelength light beam is of a value of 1.0 or more;

(3)

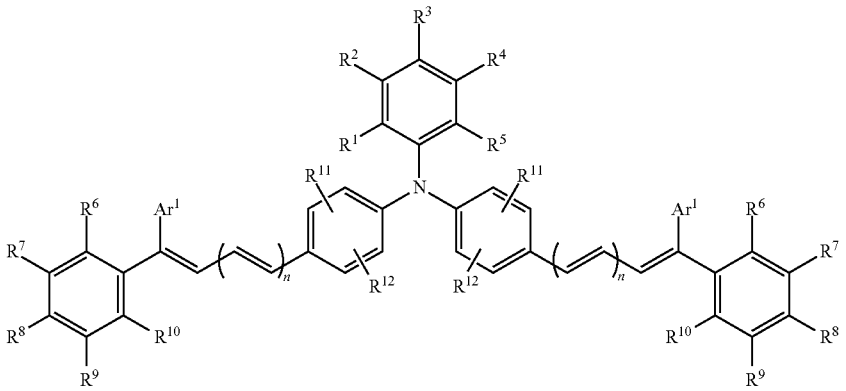

wherein in the general formula (3), $R^1$to $R^{12}$ are each independently a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, or —$OR^{13}$, wherein $R^{13}$ is an alkyl group having 1 to 10 carbon atoms, a perfluoroalkyl group, or an aryl group having 6 to 30 carbon atoms, $Ar^1$ is a hydrogen atom, a substituted or unsubstituted alkyl group having 1 to 12 carbon atoms, or a substituted or unsubstituted aryl group having 6 to 30 carbon atoms, and n is an integer of 0 to 2;

(5)

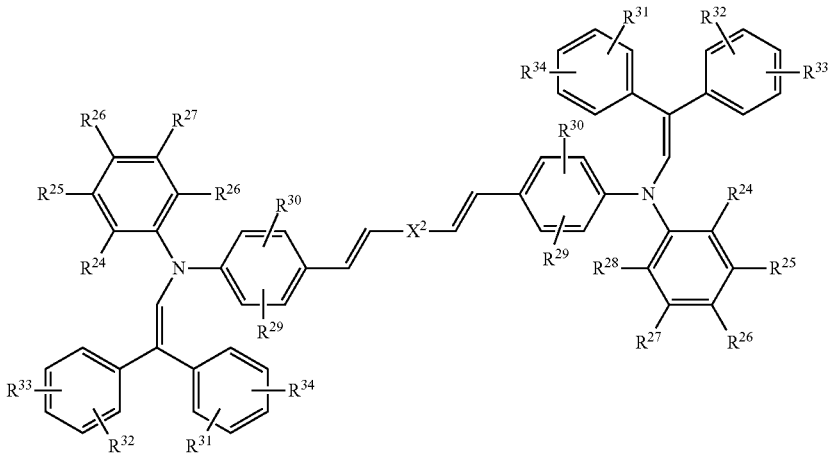

wherein in the general formula (5), $X^2$ is a substituted or unsubstituted arylene group having 6 to 30 carbon atoms, an unsubstituted hydrocarbon group having an aryl group having 6 to 30 carbon atoms, or a condensed polycyclic hydrogen group having 10 to 30 carbon atoms, $R^{24}$ to $R^{34}$ are each independently a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, or —$OR^{35}$, wherein $R^{35}$ is an alkyl group having 1 to 10 carbon atoms, a perfluoroalkyl group, or an aryl group having 6 to 30 carbon atoms, $R^{24}$ to $R^{28}$, $R^{29}$ and $R^{30}$, $R^{31}$ and $R^{34}$, and $R^{32}$ and $R^{33}$ may form a saturated or unsaturated ring by linking two substituents with each other, or $R^{26}$ may be a substituent of the following formula (5') in addition to the above mentioned substituents;

(5')

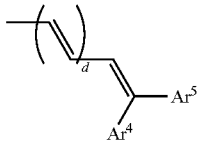

in the general formula (5'), $Ar^4$ and $Ar^5$ are a hydrogen atom, a substituted or unsubstituted alkyl group having 1 to 12 carbon atoms, or a substituted or unsubstituted aryl group having 6 to 30 carbon atoms, and d is an integer of 0 to 2;

(6)

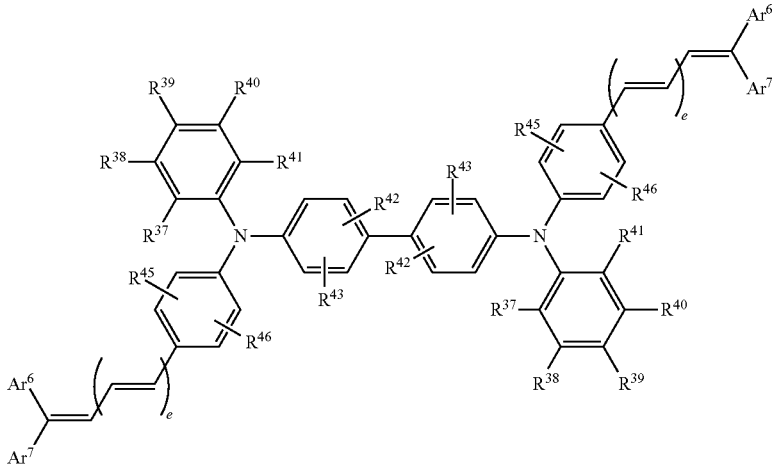

in the general formula (6), $R^{37}$ to $R^{46}$ are each independently a hydrogen atom, a halogen atom, a substituted or unsubstituted alkyl group having 1 to 12 carbon atoms, a substituted or unsubstituted alkoxy group having 1 to 12 carbon atoms, a substituted or unsubstituted aryl group having 6 to 30 carbon atoms, a substituted or unsubstituted alkenyl group having 6 to 30 carbon atoms, or —$OR^{47}$, wherein $R^{47}$ is an alkyl group having 1 to 10 carbon atoms, a perfluoroalkyl group, or an aryl group having 6 to 30 carbon atoms, $R^{37}$ to $R^{41}$, $R^{42}$ and $R^{43}$, and $R^{45}$ and $R^{46}$ may form a saturated or unsaturated ring by linking two substituents with each other, $Ar^6$ and $Ar^7$ are a hydrogen atom, a substituted or unsubstituted alkyl group having 1 to 12 carbon atoms, or a substituted or unsubstituted aryl group having 6 to 30 carbon atoms and e is an integer of 0 to 2.

8. The image forming apparatus comprising the multilayer type electrophotographic photoconductor according to claim 7, wherein the ionizing potential of the charge transporting agent is a value within a range of 5.3 to 6.0 eV.

* * * * *